US010395480B2

(12) United States Patent
Wortmann

(10) Patent No.: US 10,395,480 B2
(45) Date of Patent: Aug. 27, 2019

(54) GAMING MACHINE WITH SYMBOL ACCUMULATION

(71) Applicant: Pridefield Limited, Douglas, Isle of Man (GB)

(72) Inventor: Jonathan B. Wortmann, Ballarat (AU)

(73) Assignee: Pridefield Limited, Douglas, Isle of Man (GB)

( * ) Notice: Subject to any disclaimer, the term of this patent is extended or adjusted under 35 U.S.C. 154(b) by 129 days.

(21) Appl. No.: 15/487,838

(22) Filed: Apr. 14, 2017

(65) Prior Publication Data

US 2017/0316648 A1 Nov. 2, 2017

(30) Foreign Application Priority Data

Apr. 28, 2016 (GB) ..... 1607379.3

(51) Int. Cl.

*G07F 17/32* (2006.01)
*G07F 19/00* (2006.01)
*G07F 17/34* (2006.01)

(52) U.S. Cl.

CPC ..... *G07F 17/3262* (2013.01); *G07F 17/3213* (2013.01); *G07F 17/3244* (2013.01); *G07F 17/34* (2013.01)

(58) Field of Classification Search

CPC .. G07F 17/32; G07F 17/3213; G07F 17/3244; G07F 17/326; G07F 17/3262;

(Continued)

(56) References Cited

U.S. PATENT DOCUMENTS 5,704,835 A 1/1998 Dietz, II
6,142,872 A 11/2000 Walker et al.

(Continued)

FOREIGN PATENT DOCUMENTS

AU 2003246319 10/2003
AU 2011253848 A1 1/2014

(Continued)

OTHER PUBLICATIONS

Australian Government, IP Australia, Examination Report No. 2 dated Jul. 14, 2017, issued in connection with Australian Patent Application No. 2016202966, 6 pages.

(Continued)

*Primary Examiner* — Milap Shah
(74) *Attorney, Agent, or Firm* — McDonnell Boehnen Hulbert & Berghoff LLP

(57) ABSTRACT

An embodiment may involve selecting a first bonus set of symbols associated with respective positions of each of a plurality of reels as a first bonus outcome event of the bonus game. The embodiment may further involve incrementing a bonus counter by a number of instances of a predetermined symbol, in the bonus symbol set, that do not contribute to any winning combination. The embodiment may also involve determining that the bonus counter is at least equal to a threshold number. The embodiment may additionally involve selecting a second bonus set of symbols associated with respective positions of each of the reels as a second bonus outcome event of the bonus game, where the second bonus set of symbols includes at least the threshold number of instances of the predetermined symbol, and where the second bonus set of symbols includes a winning combination.

20 Claims, 24 Drawing Sheets

(58) Field of Classification Search
CPC ... G07F 17/3265; G07F 17/3267; G07F 17/34
See application file for complete search history.

(56) References Cited

U.S. PATENT DOCUMENTS 6,146,271 A 11/2000 Kadlic
6,186,894 B1 2/2001 Mayeroff
6,190,255 B1 2/2001 Thomas et al.
6,203,429 B1 3/2001 Demar et al.
6,224,483 B1 5/2001 Mayeroff
6,231,442 B1 5/2001 Mayeroff
6,234,897 B1 5/2001 Frohm et al.
6,251,013 B1 6/2001 Bennett
6,315,560 B1 11/2001 Krouglicof et al.
6,322,309 B1 11/2001 Thomas et al.
6,379,248 B1 4/2002 Jorasch et al.
6,439,993 B1 8/2002 O'Halloran
6,482,089 B2 11/2002 DeMar et al.
6,506,117 B2 1/2003 DeMar et al.
6,508,707 B2 1/2003 DeMar et al.
6,520,855 B2 2/2003 DeMar et al.
6,561,904 B2 5/2003 Locke et al.
6,609,971 B2 8/2003 Vancura
6,645,074 B2 11/2003 Thomas et al.
6,712,697 B2 3/2004 Acres
6,743,102 B1 6/2004 Fiechter et al.
6,852,028 B2 2/2005 Vancura
6,855,054 B2 2/2005 White et al.
6,869,360 B2 3/2005 Marks et al.
6,905,412 B2 6/2005 Thomas et al.
6,939,228 B2 9/2005 Shimizu
7,063,617 B2 6/2006 Brosnan et al.
7,090,580 B2 8/2006 Rodgers et al.
7,172,505 B2 2/2007 Vancura
7,195,560 B2 3/2007 DeMar et al.
7,237,775 B2 7/2007 Thomas et al.
7,258,611 B2 8/2007 Bigelow et al.
7,291,068 B2 11/2007 Bryant et al.
7,316,609 B2 1/2008 Dunn et al.
7,331,862 B2 2/2008 Rodgers et al.
7,331,866 B2 2/2008 Rodgers et al.
7,331,867 B2 2/2008 Baelocher et al.
7,341,518 B2 3/2008 Muskin
7,381,134 B2 6/2008 Cuddy et al.
7,390,260 B2 6/2008 Englman
7,393,278 B2 7/2008 Gerson et al.
7,419,429 B2 9/2008 Taylor
7,452,271 B2 11/2008 DeMar et al.
7,520,809 B2 4/2009 Thomas et al.
7,553,231 B2 6/2009 Rodgers et al.
7,584,505 B2 9/2009 Mondri
7,618,319 B2 11/2009 Casey et al.
7,736,222 B2 6/2010 Casey et al.
7,801,040 B1 9/2010 Singh et al.
7,819,737 B2 10/2010 Englman et al.
7,850,521 B2 12/2010 Rodgers et al.
7,857,695 B2 12/2010 Rodgers et al.
7,901,283 B2 3/2011 Thomas et al.
7,922,579 B2 * 4/2011 Walker ..... G07F 17/32 463/13
7,950,994 B2 5/2011 Berman et al.
8,029,358 B2 10/2011 Bigelow et al.
8,030,078 B2 10/2011 Robichaud
RE43,297 E 4/2012 Taylor
8,157,634 B2 4/2012 Englman et al.
8,177,630 B2 5/2012 Bryant
8,235,790 B2 8/2012 Yoshizawa
8,360,840 B2 1/2013 Bennett
8,382,576 B2 2/2013 Nakamura
8,430,743 B2 4/2013 Moshal
8,444,467 B2 5/2013 Englman et al.
8,449,382 B2 5/2013 Bryant
8,449,383 B2 5/2013 Bryant
8,460,094 B2 6/2013 Bigelow et al.
8,480,480 B2 7/2013 Thomas et al.
8,529,332 B2 9/2013 Bennett
8,535,143 B2 9/2013 Hornik et al.
8,540,565 B2 9/2013 Burghard et al.
8,585,484 B2 11/2013 Louie
8,591,312 B2 11/2013 Roukis et al.
8,591,316 B2 11/2013 Bryant
8,602,867 B2 12/2013 Owen
8,616,950 B2 12/2013 Robichaud
8,632,393 B2 1/2014 Bryant
8,636,584 B2 1/2014 Bryant
8,641,517 B2 2/2014 Bryant
8,647,194 B2 2/2014 Bigelow et al.
8,651,940 B2 2/2014 Loat et al.
8,702,489 B2 4/2014 Cuddy et al.
8,721,423 B2 5/2014 Saito
8,734,222 B2 5/2014 Owen et al.
8,734,237 B2 5/2014 Moshal
8,747,207 B2 6/2014 Thomas et al.
8,834,249 B2 9/2014 Bryant
8,864,568 B2 10/2014 Mizue
8,864,570 B2 10/2014 Jackson
8,876,589 B2 11/2014 Strom
8,974,288 B2 3/2015 Welty et al.
9,092,938 B2 7/2015 Robichaud
9,098,976 B2 8/2015 Zimmermann
9,129,480 B2 9/2015 Nakamura
9,135,781 B2 9/2015 Nakamura
9,135,782 B2 9/2015 Nakamura
9,165,436 B2 10/2015 Welty et al.
9,208,657 B2 12/2015 Fujisawa et al.
9,214,071 B2 12/2015 Hornik et al.
9,224,270 B2 12/2015 Lee et al.
9,230,411 B2 1/2016 Englman et al.
9,336,658 B2 5/2016 Suda
9,336,659 B2 5/2016 Beria
9,361,756 B2 6/2016 Bryant et al.
9,412,239 B2 8/2016 Gugler
9,424,720 B2 8/2016 Suda
9,564,001 B2 2/2017 Owen et al.
9,659,456 B2 5/2017 Van Linden
9,685,035 B2 6/2017 Schattauer et al.
9,697,694 B2 7/2017 Beria
9,792,776 B2 10/2017 Bigelow et al.
9,830,780 B2 11/2017 Cuddy et al.
9,852,588 B2 12/2017 Roukis et al.
9,911,280 B2 3/2018 Beria
9,934,646 B2 4/2018 Igesund
9,940,784 B2 4/2018 Schattauer et al.
9,959,703 B2 5/2018 Igesund
9,997,012 B2 6/2018 Wortmann et al.
10,043,348 B2 8/2018 Meyer
10,068,432 B2 9/2018 Wortmann
10,068,435 B2 9/2018 Gugler
10,078,942 B2 9/2018 Suda
10,147,264 B1 12/2018 Halvorson
10,169,956 B2 1/2019 Beria
2001/0009865 A1 7/2001 DeMar
2001/0031659 A1 10/2001 Perrie et al.
2002/0025847 A1 2/2002 Thomas et al.
2002/0039920 A1 4/2002 Bryant
2002/0043759 A1 4/2002 Vancura
2002/0045474 A1 4/2002 Singer et al.
2002/0068623 A1 6/2002 Gauselmann
2002/0132659 A1 9/2002 DeMar et al.
2002/0137560 A1 9/2002 DeMar et al.
2002/0137561 A1 9/2002 DeMar et al.
2002/0142823 A1 10/2002 DeMar et al.
2002/0151359 A1 10/2002 Rowe
2003/0060259 A1 * 3/2003 Mierau ..... G07F 17/32 463/16
2003/0064810 A1 4/2003 Okada
2003/0073483 A1 * 4/2003 Glavich ..... G07F 17/32 463/20
2003/0155715 A1 8/2003 Walker et al.
2003/0162585 A1 8/2003 Bigelow et al.
2003/0162588 A1 8/2003 Brosnan et al.
2003/0181238 A1 9/2003 DeMar et al.
2003/0190943 A1 * 10/2003 Walker ..... G07F 17/32 463/17

(56) References Cited

U.S. PATENT DOCUMENTS

2003/0199307 A1 10/2003 DeMar et al.
2003/0199309 A1 10/2003 DeMar et al.
2004/0032086 A1 2/2004 Barragan
2004/0048646 A1 3/2004 Visocnik
2004/0072607 A1 4/2004 Thomas et al.
2004/0097280 A1 5/2004 Gauselmann
2004/0162134 A1* 8/2004 Walker ..... G07F 17/32 463/20
2004/0185930 A1 9/2004 Thomas et al.
2004/0219968 A1 11/2004 Fiden et al.
2004/0242312 A1 12/2004 Gomez
2004/0254011 A1 12/2004 Muskin
2004/0259640 A1 12/2004 Gentles et al.
2005/0010715 A1 1/2005 Davies et al.
2005/0043082 A1* 2/2005 Peterson ..... G07F 17/32 463/20
2005/0054420 A1 3/2005 Cregan et al.
2005/0130731 A1 6/2005 Englman
2005/0130737 A1 6/2005 Englman
2005/0153770 A1 7/2005 Vancura
2005/0153778 A1 7/2005 Nelson et al.
2005/0170883 A1 8/2005 Muskin
2005/0181867 A1 8/2005 Thomas et al.
2005/0239545 A1 10/2005 Rowe
2006/0005239 A1 1/2006 Mondri
2006/0030396 A1 2/2006 Marks et al.
2006/0084494 A1 4/2006 Belger et al.
2006/0264254 A1 11/2006 Aoki
2006/0281525 A1 12/2006 Borissov
2007/0026933 A1 2/2007 Tanimura
2007/0054732 A1 3/2007 Baerlocher
2007/0060254 A1 3/2007 Muir
2007/0060303 A1 3/2007 Govender et al.
2007/0060314 A1 3/2007 Baerlocher et al.
2007/0060317 A1 3/2007 Martin
2007/0123340 A1 5/2007 Vancura
2007/0167226 A1 7/2007 Kelly et al.
2007/0265062 A1 11/2007 Thomas et al.
2007/0287529 A1 12/2007 Kojima
2008/0039171 A1 2/2008 Slomiany et al.
2008/0070673 A1 3/2008 Bennett et al.
2008/0076574 A1 3/2008 Okada
2008/0113742 A1 5/2008 Amos et al.
2008/0108411 A1 8/2008 Jensen et al.
2008/0254875 A1* 10/2008 Fujimoto ..... G07F 17/32 463/27
2008/0287178 A1 11/2008 Berman et al.
2009/0042652 A1* 2/2009 Baerlocher ..... G07F 17/32 463/42
2009/0054129 A1 2/2009 Yoshimura et al.
2009/0069071 A1 3/2009 Aoki et al.
2009/0098930 A1 4/2009 Kato
2009/0104979 A1 4/2009 Ruymann
2009/0117979 A1* 5/2009 Decasa, Jr. ..... G07F 17/32 463/20
2009/0131145 A1 5/2009 Aoki et al.
2009/0156303 A1 6/2009 Kiely et al.
2009/0227340 A1 9/2009 Yoshizawa
2009/0227356 A1 9/2009 Moroney
2009/0305769 A1 12/2009 Plowman
2009/0305770 A1 12/2009 Bennett et al.
2009/0325667 A1 12/2009 Weber
2009/0325674 A1 12/2009 Hosokawa
2010/0004048 A1 1/2010 Brito
2010/0004050 A1 1/2010 Caputo et al.
2010/0022297 A1 1/2010 Saunders
2010/0029381 A1 2/2010 Vancura
2010/0056249 A1 3/2010 Yamauchi
2010/0120492 A1* 5/2010 Davis ..... G07F 17/3227 463/20
2010/0120525 A1 5/2010 Baerlocher et al.
2010/0124988 A1 5/2010 Amos et al.
2010/0197377 A1 8/2010 Aoki et al.
2010/0323780 A1 12/2010 Acres
2011/0003630 A1 1/2011 Rasmussen et al.
2011/0028202 A1 2/2011 Naicker et al.
2011/0065492 A1 3/2011 Acres
2011/0081964 A1* 4/2011 Acres ..... G07F 17/3244 463/30
2011/0098101 A1 4/2011 Gomez et al.
2011/0117987 A1 5/2011 Aoki et al.
2011/0118001 A1* 5/2011 Vann ..... G07F 17/34 463/20
2011/0124394 A1 7/2011 Thomas et al.
2012/0015713 A1 1/2012 Cannon
2012/0064961 A1 3/2012 Vancura
2012/0122546 A1 5/2012 Lange
2012/0122547 A1 5/2012 Aoki et al.
2012/0244928 A1 9/2012 Visser
2012/0258787 A1 10/2012 Bennett
2012/0276980 A1 11/2012 Moroney
2012/0295688 A1 11/2012 Watkins et al.
2013/0023329 A1 1/2013 Saunders
2013/0065662 A1 3/2013 Watkins et al.
2013/0143635 A1 6/2013 Arora et al.
2013/0157733 A1 6/2013 Thorne et al.
2013/0184047 A1 7/2013 Haykin et al.
2013/0244762 A1 9/2013 Walker et al.
2013/0281191 A1 10/2013 Thomas et al.
2013/0288793 A1 10/2013 Fujisawa et al.
2013/0344939 A1 12/2013 Aoki et al.
2014/0051494 A1 2/2014 Marks et al.
2014/0066169 A1 3/2014 Watkins
2014/0135096 A1 5/2014 Aida et al.
2014/0179400 A1 6/2014 Lee
2014/0228091 A1 8/2014 Berman et al.
2014/0274292 A1 9/2014 Suda
2014/0287814 A1 9/2014 Berman et al.
2014/0295939 A1 10/2014 Thomas et al.
2014/0323198 A1 10/2014 Tuck
2014/0339767 A1* 11/2014 Hirato ..... G07F 17/34 273/143 R
2014/0342807 A1 11/2014 Vancura
2015/0018069 A1 1/2015 Montenegro et al.
2015/0057068 A1 2/2015 Burghard
2015/0213677 A1 7/2015 Haykin et al.
2015/0248810 A1 9/2015 Wortmann et al.
2015/0248811 A1 9/2015 Wortmann et al.
2015/0287276 A1 10/2015 Humphrey et al.
2015/0302704 A1 10/2015 Montenegro et al.
2015/0363999 A1 12/2015 Little
2016/0104345 A1 4/2016 MacGregor et al.
2016/0140795 A1 5/2016 Fong et al.
2016/0180637 A1 6/2016 Honeycutt et al.
2016/0328910 A1 11/2016 Shaik
2016/0351005 A1 12/2016 Igesund
2016/0351006 A1 12/2016 Igesund
2017/0069160 A1 3/2017 Bennett
2017/0092041 A1 3/2017 Kudo
2017/0092042 A1 3/2017 Nakamura
2017/0162003 A9 6/2017 Burghard
2017/0213416 A1 7/2017 Wortmann
2017/0316649 A1 11/2017 Wortmann
2017/0316651 A1 11/2017 Wortmann et al.
2018/0122182 A1 5/2018 Wortmann
2018/0122183 A1 5/2018 Wortmann
2018/0122184 A1 5/2018 Wortmann
2018/0122189 A1 5/2018 Wortmann
2018/0225926 A1 8/2018 Wortmann
2018/0286174 A1 10/2018 Merkel et al.
2018/0286175 A1 10/2018 Kuhlmann et al.
2018/0374296 A1 12/2018 Bennett
2019/0019370 A1 1/2019 Ono

FOREIGN PATENT DOCUMENTS

AU 2013251288 5/2014
CA 2827968 3/2014
CA 2868773 4/2015
EP 1351180 10/2003
EP 2615591 3/2013
EP 2713347 4/2014
EP 2866211 4/2015

(56) References Cited

FOREIGN PATENT DOCUMENTS

| | | | |
|---|---|---|---|
| EP | 2894612 | | 7/2015 |
| EP | 2916299 | | 9/2015 |
| GB | 2139390 | | 11/1984 |
| GB | 2393018 | | 3/2004 |
| WO | 2002/41963 | | 5/2002 |
| WO | 2006/027677 | | 3/2006 |
| WO | 2008/063394 | A3 | 5/2008 |
| ZA | 201400816 | | 10/2014 |

OTHER PUBLICATIONS

European Patent Office, Extended European Search Report dated Jun. 6, 2017, issued in connection with Application No. EP 171531445, 9 pages.
Australian Government, IP Australia, Examination Report No. 1 dated Mar. 28, 2017, issued in connection with Australian Patent Application No. 2016202966, 2 pages.
Australian Government, IP Australia, Examination Report No. 1 dated Mar. 29, 2017, issued in connection with Australian Patent Application No. 2016202965, 3 pages.
Australian Government, IP Australia, Patent Examination Report No. 1, dated Dec. 20, 2012, issued in connection with Australian Patent Application No. 2011253848, 4 pages.
Canadian Intellectual Property Office, Examiner's Report dated Dec. 7, 2016, issued in connection with CA Application No. 2929222, 3 pages.
Canadian Intellectual Property Office, Office Action dated Mar. 13, 2017, issued in connection with Canadian Patent Application No. 2929218, 6 pages.
Canadian Intellectual Property Office, Examiner's Report dated Feb. 5, 2013, issued in connection with CA Application No. 27602112, 2 pages.
European Patent Office, European Search Report dated Jul. 27, 2016, issued in connection with EP Application No. 16171834.1, 8 pages.
European Patent Office, European Search Report dated Jun. 28, 2016, issued in connection with EP Application No. 16171832.5, 8 pages.
European Patent Office, Extended European Search Report dated Feb. 24, 2012, issued in connection with EP Application No. 11194636.4, 6 pages.
European Patent Office, Extended European Search Report dated Oct. 26, 2010, issued in connection with EP Application No. 10251152.4, 8 pages.
European Patent Office, Supplementary European Search Report dated Oct. 8, 2008, issued in connection with EP Application No. 05789874.4, 6 pages.
Final Office Action dated Sep. 14, 2012, issued in connection with U.S. Appl. No. 12/511,391, filed Jul. 29, 2009, 14 pages.
Final Office Action dated Jun. 23, 2010, issued in connection with U.S. Appl. No. 10/550,744, filed Aug. 24, 2006, 13 pages.
Final Office Action dated Sep. 28, 2009, issued in connection with U.S. Appl. No. 10/550,744, filed Aug. 24, 2006, 11 pages.
Intellectual Property Office, Combined Search Report and Abbreviated Examination Report dated Nov. 29, 2016, issued in connection with Application No. GB1509339.6, 7 pages.
Intellectual Property Office, Combined Search Report and Abbreviated Examination Report dated Nov. 29, 2016, issued in connection with Application No. GB1509340.4, 7 pages.
International Bureau, International Preliminary Report on Patentability dated Mar. 13, 2007, issued in connection with International Application No. PCT/IB2005/002678, filed on Sep. 9, 2005, 4 pages.
International Searching Authority, International Search Report and Written Opinion dated Jan. 16, 2007, issued in connection with International Application No. PCT/IB2005/002678, filed on Sep. 9, 2005, 8 pages.
Non-Final Office Action dated Apr. 2008, issued in connection with U.S. Appl. No. 10/550,744, filed Aug. 24, 2006, 8 pages.
Non-Final Office Action dated Dec. 10, 2012, issued in connection with U.S. Appl. No. 12/974,690, filed Dec. 21, 2009, 25 pages.
Non-Final Office Action dated Dec. 24, 2009, issued in connection with U.S. Appl. No. 10/550,744, filed Aug. 24, 2006, 12 pages.
Non-Final Office Action dated Mar. 29, 2012, issued in connection with U.S. Appl. No. 12/511,391, filed Jul. 29, 2009, 10 pages.
Non-Final Office Action dated Nov. 29, 2013, issued in connection with U.S. Appl. No. 13/856,124, filed Apr. 3, 2013, 19 pages.
Non-Final Office Action dated Jul. 31, 2013, issued in connection with U.S. Appl. No. 13/856,124, filed Apr. 3, 2013, 19 pages.
Notice of Allowability dated Nov. 26, 2010, issued in connection with U.S. Appl. No. 10/550,744, filed Aug. 24, 2006, 4 pages.
Notice of Allowance dated Apr. 10, 2014, issued in connection with U.S. Appl. No. 13/856,124, filed Apr. 3, 2013, 7 pages.
Notice of Allowance dated Mar. 11, 2013, issued in connection with U.S. Appl. No. 12/974,690, filed Dec. 21, 2009, 14 pages.
Wortman, Jonathan, U.S. Appl. No. 15/392,946, filed Dec. 28, 2016, 44 pages.
Canadian Intellectual Property Office, Examiner's Report dated Jan. 16, 2018, issued in connection with Canadian Patent Application No. 2,929,218, 8 pages.
Australian Government, IP Australia, Examination Report No. 3 dated Nov. 21, 2017, issued in connection with Australian Patent Application No. 2016202966, 4 pages.
Notice of Allowance dated Dec. 20, 2017, issued in connection with U.S. Appl. No. 15/141,010, filed Apr. 28, 2016, 8 pages.
Non-Final Office Action dated Jan. 29, 2018, issued in connection with U.S. Appl. No. 15/487,869, filed Apr. 14, 2017, 12 pages.
Australian Government, IP Australia, Examination Report No. 1 dated Oct. 14, 2017, issued in connection with Australian Patent Application No. 2017200271, 4 pages.
Canadian Intellectual Property Office, Examiner's Report dated Dec. 19, 2017, issued in connection with Canadian Patent Application No. 2,954,790, 3 pages.
United Kingdom Intellectual Property Office, Search Report dated Jun. 28, 2017, issued in connection with Great Britain Patent Application No. 1601306.2, 6 pages.
Australian Government, IP Australia, Examination Report No. 2 dated Jun. 26, 2017, issued in connection with Australian Patent Application No. 2016202965, 2 pages.
Australian Government, IP Australia, Examination Report No. 3 dated Oct. 12, 2017, issued in connection with Australian Patent Application No. 2016202965, 3 pages.
Canadian Intellectual Property Office, Examiner's Report dated Dec. 19, 2017, issued in connection with Canadian Patent Application No. 2,929,222, 6 pages.
European Patent Office, Office Action dated Aug. 23, 2017, issued in connection with EP Application No. 16171832.5, 7 pages.
Non-Final Office Action dated Oct. 18, 2017, issued in connection with U.S. Appl. No. 15/140,945, filed Apr. 28, 2016, 12 pages.
Notice of Allowance dated Jan. 16, 2018, issued in connection with U.S. Appl. No. 15/140,945, filed Apr. 28, 2016, 5 pages.
Non-Final Office Action dated Feb. 20, 2018, issued in connection with U.S. Appl. No. 15/485,984, filed Apr. 12, 2017, 11 pages.
Notice of Allowance dated Feb. 13, 2018, issued in connection with U.S. Appl. No. 15/141,010, filed Apr. 28, 2016, 5 pages.
Australian Government, IP Australia, Examination Report No. 1 dated Jan. 30, 2018, issued in connection with Australian Patent Application No. 2017202577, 2 pages.
Australian Government, IP Australia, Examination Report No. 1 dated Jan. 30, 2018, issued in connection with Australian Patent Application No. 2017202579, 2 pages.
Australian Government, IP Australia, Examination Report No. 1 dated Jan. 30, 2018, issued in connection with Australian Patent Application No. 2017202474, 2 pages.
Australian Government, IP Australia, Examination Report No. 1 dated Jan. 30, 2018, issued in connection with Australian Patent Application No. 2017202574, 2 pages.
Australian Government, IP Australia, Examination Report No. 4 dated Feb. 19, 2018, issued in connection with Australian Patent Application No. 2016202965, 3 pages.

(56) References Cited

OTHER PUBLICATIONS

United Kingdom Intellectual Property Office, Search Report dated Aug. 16, 2017, issued in connection with Great Britain Patent Application No. 1607379.3, 6 pages.
United Kingdom Intellectual Property Office, Search Report dated Aug. 11, 2017, issued in connection with Great Britain Patent Application No. 1607380.1, 8 pages.
Australian Government, IP Australia, Notice of Acceptance dated Sep. 25, 2013, issued in connection with Australian Patent Application No. 2011253848, 2 pages.
Australian Government, IP Australia, Examination Report No. 4 dated Mar. 9, 2018, issued in connection with Australian Patent Application No. 2016202966, 3 pages.
Australian Government, IP Australia, Examination Report No. 2 dated Mar. 6, 2018, issued in connection with Australian Patent Application No. 2017200271, 3 pages.
Australian Government, IP Australia, Examination Report No. 3 dated Jun. 5, 2018, issued in connection with Australian Patent Application No. 2017200271, 3 pages.
Australian Government, IP Australia, Examination Report No. 2 dated May 11, 2018, issued in connection with Australian Patent Application No. 2017202474, 4 pages.
Australian Government, IP Australia, Examination Report No. 2 dated May 14, 2018, issued in connection with Australian Patent Application No. 2017202574, 4 pages.
Australian Government, IP Australia, Examination Report No. 2 dated May 14, 2018, issued in connection with Australian Patent Application No. 2017202577, 3 pages.
Australian Government, IP Australia, Examination Report No. 2 dated May 14, 2018, issued in connection with Australian Patent Application No. 2017202579, 4 pages.
Australian Government, IP Australia, Examination Report No. 1 dated Mar. 20, 2018, issued in connection with Australian Patent Application No. 2017235913, 2 pages.
Australian Government, IP Australia, Examination Report No. 1 dated Mar. 6, 2018, issued in connection with Australian Patent Application No. 2017235921, 2 pages.
Australian Government, IP Australia, Examination Report No. 1 dated Mar. 6, 2018, issued in connection with Australian Patent Application No. 2017235939, 2 pages.
Australian Government, IP Australia, Examination Report No. 1 dated Mar. 6, 2018, issued in connection with Australian Patent Application No. 2017235945, 2 pages.
Canadian Intellectual Property Office, Examiner's Report dated Feb. 6, 2014, issued in connection with Canadian Patent Application No. 2,760,112, 3 pages.
Canadian Intellectual Property Office, Examiner's Report dated Mar. 18, 2015, issued in connection with Canadian Patent Application No. 2,760,112, 6 pages.
Canadian Intellectual Property Office, Final Office Action dated Dec. 2, 2016, issued in connection with Canadian Patent Application No. 2,760,112, 5 pages.
Canadian Intellectual Property Office, Examiner's Report dated May 11, 2018, issued in connection with Canadian Patent Application No. 2,964,233, 5 pages.
Canadian Intellectual Property Office, Examiner's Report dated Mar. 29, 2018, issued in connection with Canadian Patent Application No. 2,964,558, 6 pages.
Canadian Intellectual Property Office, Examiner's Report dated May 11, 2018, issued in connection with Canadian Patent Application No. 2,964,587, 5 pages.
Canadian Intellectual Property Office, Examiner's Report dated Apr. 24, 2018, issued in connection with Canadian Patent Application No. 2,964,739, 5 pages.
European Patent Office, Office Action dated Sep. 10, 2013, issued in connection with EP Application No. 11194636.4, 5 pages.
United Kingdom Intellectual Property Office, Search Report dated Apr. 13, 2018, issued in connection with Great Britain Patent Application No. 1618347.7, 6 pages.
United Kingdom Intellectual Property Office, Search Report dated Apr. 17, 2018, issued in connection with Great Britain Patent Application No. 1618349.3, 7 pages.
United Kingdom Intellectual Property Office, Search Report dated Apr. 17, 2018, issued in connection with Great Britain Patent Application No. 1618352.7, 7 pages.
United Kingdom Intellectual Property Office, Search Report dated Apr. 13, 2018, issued in connection with Great Britain Patent Application No. 1618353.5, 6 pages.
Notice of Allowance dated Mar. 8, 2018, issued in connection with U.S. Appl. No. 15/140,945, filed Apr. 28, 2016, 5 pages.
Notice of Allowance dated Apr. 11, 2018, issued in connection with U.S. Appl. No. 15/485,984, filed Apr. 12, 2017, 7 pages.
Non-Final Office Action dated May 22, 2018, issued in connection with U.S. Appl. No. 15/487,022, filed Apr. 13, 2017, 12 pages.
Non-Final Office Action dated Dec. 26, 2018, issued in connection with U.S. Appl. No. 15/392,946, filed Dec. 28, 2016, 13 pages.
Canadian Intellectual Property Office, Examiner's Report dated Jan. 15, 2019, issued in connection with Canadian Patent Application No. 2,929,218, 6 pages.
Australian Examination Report No. 4 dated Sep. 28, 2018, issued in connection with Australian Patent Application No. 2017200271, 5 pages.
Notice of Allowance dated Oct. 29, 2018, issued in connection with U.S. Appl. No. 15/487,022, filed Apr. 13, 2017, 5 pages.
Notice of Allowance dated Jul. 18, 2018, issued in connection with U.S. Appl. No. 15/487,869, filed Apr. 14, 2017, 9 pages.
Australian Government, IP Australia, Examination Report No. 1 dated Oct. 12, 2018, issued in connection with Australian Patent Application No. 2018200695, 4 pages.
Notice of Allowance dated Jan. 8, 2019, issued in connection with U.S. Appl. No. 16/056,721, filed Aug. 7, 2018, 5 pages.
Non-Final Office Action dated Sep. 25, 2018, issued in connection with U.S. Appl. No. 16/056,721, filed Aug. 7, 2018, 10 pages.
Australian Government, IP Australia, Examination Report No. 3 dated Jul. 23, 2018, issued in connection with Australian Patent Application No. 2017101574, 4 pages.
Australian Government, IP Australia, Examination Report No. 4 dated Jan. 15, 2019, issued in connection with Australian Patent Application No. 2017101574, 4 pages.
Australian Government, IP Australia, Examination Report No. 2 dated Aug. 9, 2018, issued in connection with Australian Patent Application No. 2017235913, 4 pages.
Australian Government, IP Australia, Examination Report No. 3 dated Jan. 15, 2019, issued in connection with Australian Patent Application No. 2017235913, 3 pages.
Australian Government, IP Australia, Examination Report No. 2 dated Jun. 25, 2018, issued in connection with Australian Patent Application No. 2017235921, 3 pages.
Australian Government, IP Australia, Examination Report No. 3 dated Sep. 28, 2018, issued in connection with Australian Patent Application No. 2017235921, 3 pages.
Australian Government, IP Australia, Examination Report No. 4 dated Jan. 31, 2019, issued in connection with Australian Patent Application No. 2017235921, 3 pages.
Australian Government, IP Australia, Examination Report No. 5 dated Mar. 4, 2019 issued in connection with Australian Patent Application No. 2017235921, 3 pages.
Australian Government, IP Australia, Examination Report No. 2 dated Aug. 21, 2018, issued in connection with Australian Patent Application No. 2017235939, 4 pages.
Australian Government, IP Australia, Examination Report No. 3 dated Jan. 18, 2019, issued in connection with Australian Patent Application No. 2017235939, 3 pages.
Australian Government, IP Australia, Examination Report No. 4 dated Mar. 6, 2019, issued in connection with Australian Patent Application No. 2017235939, 3 pages.
Australian Government, IP Australia, Examination Report No. 2 dated Jul. 24, 2018, issued in connection with Australian Patent Application No. 2017235945, 4 pages.
Australian Government, IP Australia, Examination Report No. 3 dated Feb. 4, 2019, issued in connection with Australian Patent Application No. 2017235945, 3 pages.

(56) References Cited

OTHER PUBLICATIONS

Australian Government, IP Australia, Examination Report No. 4 dated Mar. 5, 2019, issued in connection with Australian Patent Application No. 2017235945, 3 pages.
Canadian Intellectual Property Office, Examiner's Report dated Nov. 1, 2018, issued in connection with Canadian Patent Application No. 2,954,790, 5 pages.
European Patent Office, Office Action dated Aug. 21, 2018, issued in connection with European Patent Application No. 17153144.5, 10 pages.
United Kingdom Intellectual Property Office, Combined Search Report dated Sep. 20, 2017, issued in connection with Great Britain Patent Application No 1607374.4, 7 pages.
United Kingdom Intellectual Property Office, Examination Report dated Jul. 30, 2018, issued in connection with Great Britain Patent Application No. 1701938.1, 6 pages.
Non-Final Office Action dated Jan. 29, 2018, issued in connection with U.S. Appl. No. 15/487,869, flied Apr. 14, 2017, 12 pages.
Canadian Intellectual Property Office, Examiner's Report dated Apr. 9, 2019, issued in connection with Canadian Patent Application No. 2,964,587, 6 pages.
Non-Final Office Action dated Apr. 29, 2019, issued in connection with U.S. Appl. No. 15/795,546, filed Oct. 27, 2017, 11 pages.
Notice of Allowance dated Feb. 21, 2019, issued in connection with U.S. Appl. No. 16/056,721, filed Aug. 7, 2018, 7 pages.
Final Office Action dated Apr. 1, 2019, issued in connection with U.S. Appl. No. 15/392,946, filed Dec. 28, 2016, 16 pages.

* cited by examiner

345

600

GAMING MACHINE WITH SYMBOL ACCUMULATION

CROSS-REFERENCE TO RELATED APPLICATION

This application claims priority to U.K. patent application no. 1607379.3 filed Apr. 28, 2016, which is hereby incorporated by reference in its entirety.

BACKGROUND

Wager games come in a variety of forms, including for example a mechanical slot machine. A mechanical slot machine may include one or more reels, each of which includes a fixed pattern of symbols distributed around the circumference of the reel. When a player places a wager (e.g., by placing a coin in the machine), the player is allowed to spin the reels. Each reel then comes to rest, typically with either one of the symbols, or a space in between symbols, in alignment with a pay line. A predefined winning symbol or a predefined combination of winning symbols that are aligned with the pay line can result in the player winning the game and receiving a payout. In one example, the machine may include three reels, and the pay line may be a horizontal line disposed across a centre of each of the three reels.

In another example of a wager game, a mechanical slot machine may present symbols in a matrix arrangement, with each symbol changing during a spin of the game according to the fixed pattern of symbols on the reels. For example, the machine may have five columns and three rows of symbols, for a total of fifteen symbols. Such machines often have multiple pay lines, each being defined by a collection of positions within the matrix. For example, the machine may have three pay lines, each corresponding to one row of the matrix.

SUMMARY

While slot machines were traditionally mechanical, modern slot machines often take the form of a video gaming machine (e.g., a dedicated gaming machine located in a casino) that includes a graphical user interface (GUI), and that may emulate a mechanical slot machine. With a video gaming machine, the GUI may display an image of one or more reels or a matrix as described above, together with animation effects to simulate a spin of the one or more reels, or a spin of the columns or rows of the matrix. A computer software program, which may reside in the video gaming machine, may randomly select one or more symbols in response to a spin, and may display the selected one or more symbols on the display.

A modern slot machine may also be played over a computer network, such as by a player using a client machine that is connected to a server machine over the computer network. In this instance, the server machine may perform the spins of the game and may send the resulting symbols to the client machine for display.

The popularity of video slot games has increased due to the incorporation of novel features, such as a "Wild" symbol, into such games. A Wild symbol, which is usually the highest-ranking symbol of the game, offers line payouts, just like any other symbol and, additionally, substitutes for any other symbol in the game, thereby assisting in making winning results and providing a player with entertainment and additional opportunities to win games.

Viewed from a first aspect, the disclosure provides a computer-implemented embodiment for symbol replacement in a reel-based game. The reel-based game may be executed on behalf of a client machine. The reel-based game may include a base game and a bonus game, both involving spinning a plurality of reels to determine outcome events. A memory may store respective pluralities of symbols for the reels. The embodiment may involve selecting, by one or more processors and from the memory, a set of symbols associated with respective positions of each of the reels as a base outcome event of the base game. The embodiment may further involve determining, by the one or more processors, that the base outcome event includes a trigger event that causes execution of the bonus game. The embodiment may also involve selecting, by the one or more processors and from the memory, a first bonus set of symbols associated with respective positions of each of the reels as a first bonus outcome event of the bonus game. The embodiment may additionally involve incrementing, by the one or more processors, a bonus counter by a number of instances of a predetermined symbol, in the bonus symbol set, that do not contribute to any winning combination. The embodiment may further involve determining, by the one or more processors, that the bonus counter is at least equal to a threshold number. The embodiment may also involve selecting, by the one or more processors and from the memory, a second bonus set of symbols associated with respective positions of each of the reels as a second bonus outcome event of the bonus game. The second bonus set of symbols may include at least the threshold number of instances of the predetermined symbol. The second bonus set of symbols may include a winning combination.

Viewed from a second aspect, an embodiment may involve determining, by one or more processors of a gaming machine, that a trigger event for a bonus game occurred during a base outcome event of a base game. The base game and the bonus game may both be reel-based games being executed on behalf of a client machine. Both the base game and the bonus game may involve spinning a plurality of reels, each reel containing a respective plurality of symbols, to determine outcome events. A memory of the gaming machine may store respective pluralities of symbols for the reels, including a predetermined symbol of the bonus game. The embodiment may additionally involve, possibly in response to determining that the trigger event occurred, awarding, by the one or more processors, a number of spins of the reels in an instance of the bonus game. The embodiment may also involve, until a terminating condition of the bonus game is reached, the one or more processors repeatedly carrying out iterations of bonus game operations. These operations may involve (i) selecting, from the stored pluralities of symbols for the reels, a symbol set for display on the plurality of reels, where the selected symbol set represents an outcome of a bonus game spin of the plurality of reels, where, when the selected symbol set includes one or more predetermined symbols that are not part of any winning combination, the one or more predetermined symbols are accumulated, and where, when at least a threshold number of predetermined symbols are accumulated, the accumulated predetermined symbols are deployed into the selected symbol set such that the selected symbol set includes a winning combination, and (ii) transmitting, to the client machine, a representation of the selected symbol set, where reception of the selected symbol set causes the client machine to display the bonus game spin of the plurality of reels resulting in the selected symbol set.

Viewed from a third aspect, the disclosure provides an article of manufacture including a non-transitory computer-readable medium, having stored thereon program instructions that, upon execution by a gaming machine, cause the gaming machine to perform the operations of the first and/or second aspect.

Viewed from a fourth aspect, the disclosure provides a gaming machine configured to perform the operations of the first and/or second aspect.

Viewed from a fifth aspect, the disclosure provides a system comprising means for performing the operations of the first and/or second aspect.

Viewed from a sixth aspect, the disclosure provides a gaming system that comprises a plurality of gaming devices each including at least one display device and a plurality of input devices including: (i) an acceptor of a physical item associated with a monetary value, (ii) a validator configured to identify the physical item, and (iii) a cash-out button actuatable to cause an initiation of a payout associated with a credit account; one or more gaming device processors; and one or more gaming device memory devices storing (i) respective pluralities of symbols for the reels and (ii) a plurality of gaming device instructions. The gaming device instructions may be executable by the one or more gaming device processors to perform the operations of the first and/or second aspect.

In embodiments of the disclosure in which a computer software product is used, the product may be non-transitory and store instructions on physical media such as a DVD, or a solid state drive, or a hard drive. Alternatively, the product may be transitory and in the form of instructions provided over a connection such as a network connection which is linked to a network such as the Internet.

These aspects, as well as other embodiments, aspects, advantages, and alternatives will become apparent to those of ordinary skill in the art by reading the following detailed description, with reference where appropriate to the accompanying drawings. Further, this summary and other descriptions and figures provided herein are intended to illustrate embodiments by way of example only and, as such, that numerous variations are possible. For instance, structural elements and process steps can be rearranged, combined, distributed, eliminated, or otherwise changed, while remaining within the scope of the embodiments as claimed.

DETAILED DESCRIPTION

I. Introduction

This description describes several example embodiments including, but not limited to, example embodiments pertaining to performing aspects of an outcome event using a machine. Performing the outcome event can include playing a game. The machine can display a variety of symbols during performance of an outcome event. A symbol displayed within a symbol-display-portion of a display during an outcome event may be replaced by another symbol. The replacement symbols can be used to determine a payout amount for an outcome event in which a wager is won.

Throughout this description, the articles "a" or "an" are used to introduce elements of the example embodiments. Any reference to "a" or "an" refers to "at least one," and any reference to "the" refers to "the at least one," unless otherwise specified, or unless the context clearly dictates otherwise. The intent of using the conjunction "or" within a described list of at least two terms is to indicate any of the listed terms or any combination of the listed terms.

The use of ordinal numbers such as "first," "second," "third" and so on is to distinguish respective elements rather than to denote a particular order of those elements. For purpose of this description, the terms "multiple" and "a plurality of" refer to "two or more" or "more than one."

Further, unless context suggests otherwise, the features illustrated in each of the figures may be used in combination with one another. Thus, the figures should be generally viewed as component aspects of one or more overall embodiments, with the understanding that not all illustrated features are necessary for each embodiment.

Disclosed herein are machines and methods for carrying out aspects of outcome events that include displaying symbols, such as games, in particular, wager games. In one aspect, the machines and methods provide a feature that may enhance traditional wager games (e.g., slot machines or other reel-type games) by providing a player with additional opportunities to win the game, thereby increasing the player's interest, anticipation, and excitement in connection with the game. This may in turn benefit a casino or another entity that provides a game with this feature. Indeed, wager games are typically configured to have odds that favour the casino (sometimes referred to as the "house"). Accordingly, based on the law of averages, casinos often maximize their profits simply by getting more players to play more games. Due to the provided feature, players may be drawn in (e.g., from competing casinos that lack games with such a feature) and they may play the game often. The feature can include new data communications between a server machine and a client machine within a server-client based configuration.

II. Example Architecture

Figure 1:
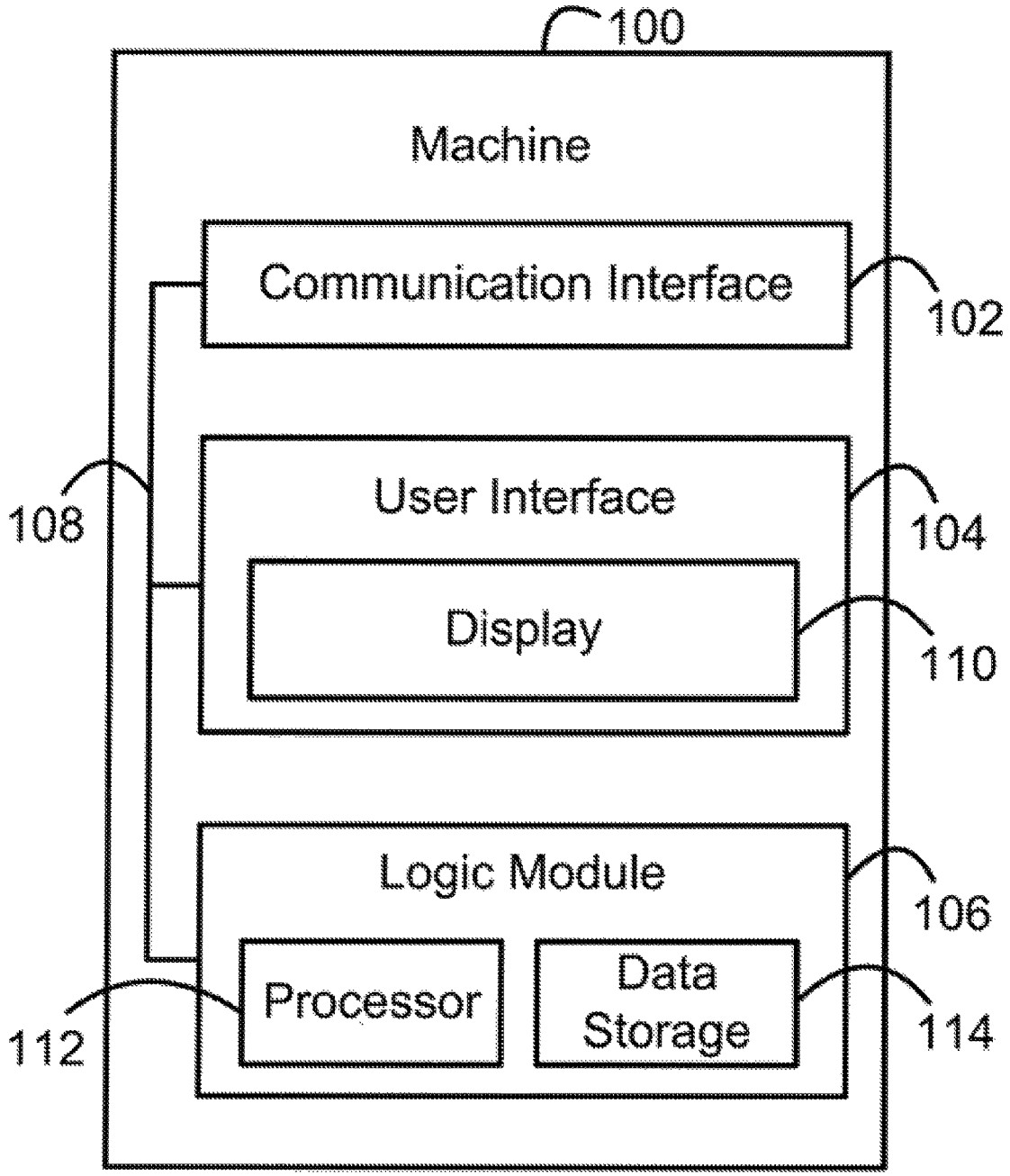
FIG. 1 is a simplified block diagram of a machine, in accordance with example embodiments.

FIG. 1 shows a simplified block diagram of an example machine 100 arranged to implement operations in accordance with example methods described herein. Machine 100 may take any of a variety of forms, including for example a dedicated gaming machine, a personal computer, a server computer, a personal digital assistant, a mobile phone, a tablet device, or some other computing device.

Machine 100 may include a communication interface 102, a user interface 104, and a logic module 106, all of which may be coupled together by a system bus, network, or other connection mechanism 108. The communication interface 102 may include a wired or wireless network communication interface. For purposes of this description, any data described as being provided, sent, or transmitted by machine 100 can be data sent by communication interface 102 over a communication network. Also, for purposes of this description, any data described as being received by machine 100 can be data sent to communication interface 102 over a communication network.

The user interface 104 may facilitate interaction with a user (e.g., a player of a game) if applicable. As such, the user interface 104 may take the form of a GUI and may include output components such as a speaker and a display 110, and input components such as a keypad or a touch-sensitive screen. As described in greater detail below, display 110 may be configured to display, among other things, a symbol set in a game or a portion thereof.

The logic module 106 can take the form of a processor 112 and a data storage 114. The processor 112 can include a general-purpose processor (e.g., a microprocessor) or a special-purpose processor (e.g., a digital signal processor or an application specific integrated circuit) and may be integrated in whole or in part with the communication interface 102 or the user interface 104. Any processor discussed in this description or shown in the drawings can be referred to as a computer-readable processor. Any data storage discussed in this description or shown in the drawings can be referred to as computer-readable data storage.

Data storage 114 may include volatile or non-volatile storage components and may be integrated in whole or in part with processor 112. Data storage 114 may take the form of a non-transitory computer-readable medium and may include software program instructions, that when executed by processor 112, cause machine 100 to perform one or more of the operations described herein. Any software program instructions discussed in this description or shown in the drawings can be referred to as computer-readable program instructions, or more simply, program instructions.

Data storage 114 may also include operating system software on which machine 100 may operate. For example, machine 100 may operate on a Windows®-based operating system (e.g., Windows 7 or Windows 10) provided by the Microsoft® Corporation of Redmond, Wash. Other examples of operating systems are possible.

Figure 2:
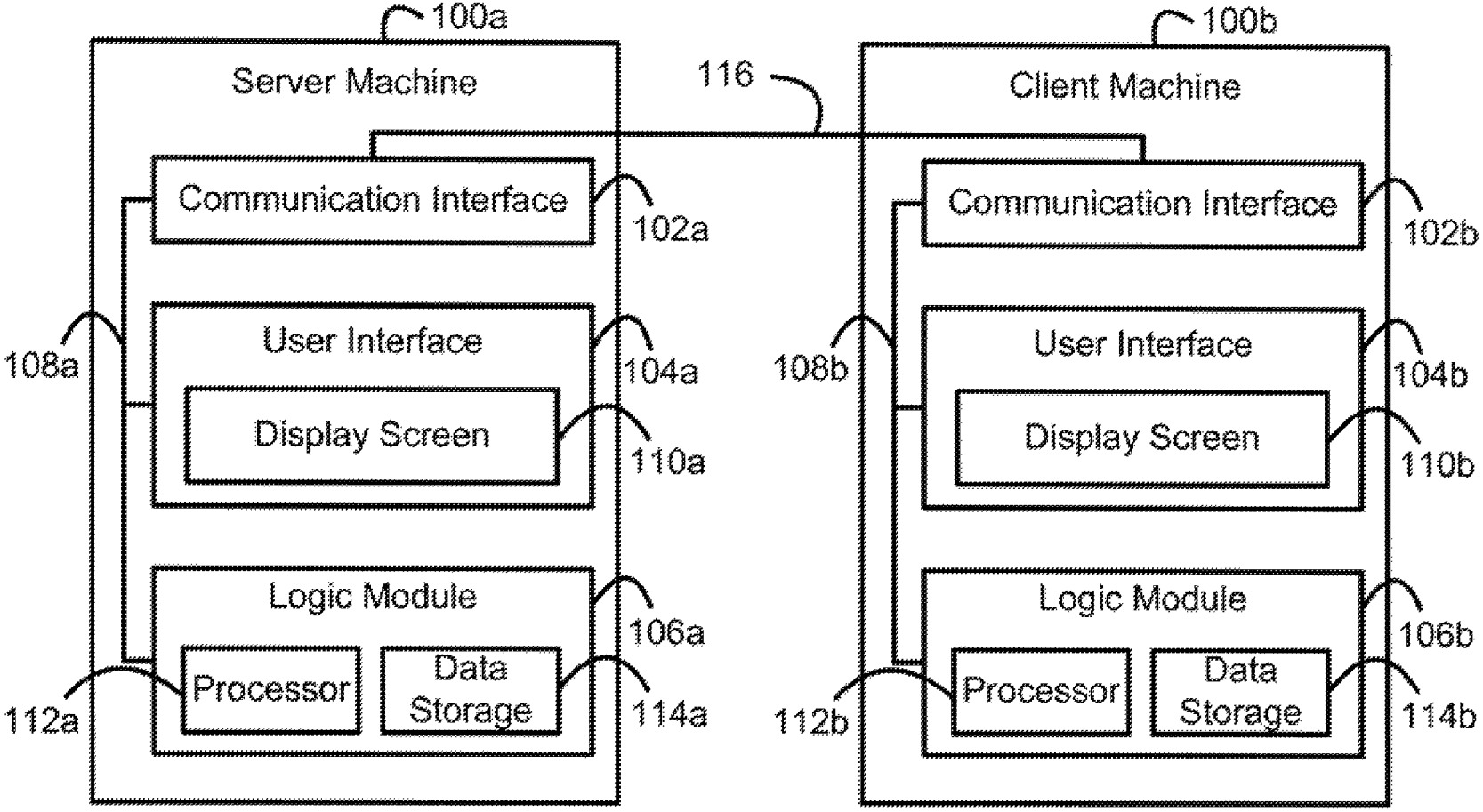
FIG. 2 is a simplified block diagram of an example server machine connected to an example client machine over a computer network, in accordance with example embodiments.

FIG. 2 is a simplified block diagram of an example server machine 100*a* connected to an example client machine (sometimes referred to as a workstation) 100*b* over a computer-network 116. A configuration of elements including server machine 100*a* and client machine 100*b* can be referred to as a server-client based configuration.

The components of the server machine 100*a* and the client machine 100*b* are shown with corresponding "a" and "b" reference numerals (i.e., based on machine 100). Server machine 100*a* includes communication interface 102*a*, user interface 104*a* (which incorporates display screen 110*a*), logic module 106*a* (which incorporates processor 112*a* and data storage 114*a*), and communication bus 108*a*. Likewise, client machine 100*b* includes communication interface 102*b*, user interface 104*b* (which incorporates display screen 110*b*), logic module 106*b* (which incorporates processor 112*b* and data storage 114*b*), and communication bus 108*b*.

The server machine 100*a* is configured to communicate with the client machine 100*b* over the computer-network 116 (via the communication interfaces 102*a*, 102*b*). Likewise, the client machine 100*b* is configured to communicate with the server machine 100*a* over the computer-network 116. For purposes of this description, any data described as being sent or transmitted by the server machine 100*a* can be data sent by communication interface 102*a* over communication network 116. Similarly, any data described as being sent or transmitted by the client machine 100*b* can be data sent by communication interface 102*b* over communication network 116. Furthermore, for purposes of this description, any data described as being received by the server machine 100*a* can be data the server machine 100*a* receives from the communication network 116 using communication interface 102*a*. Similarly, any data described as being received by the client machine 100*b* can be data the client machine 100*b* receives from the communication network 116 using communication interface 102*b*.

The computer-network 116 for the server-client based configuration described above may take a variety of forms. For example, the computer-network 116 may be a local area network (LAN) in a casino, such that client machines 100*b* dispersed throughout the casino may communicate with the server machine 100*a* in the casino.

In another example, the computer-network 116 may be a wide-area network (WAN), such as an Internet network or a network of the World Wde Web. In such a configuration, the client machine 100*b* may communicate with the server machine 100*a* via a website portal (for a virtual casino) hosted on the server machine 100*a*. The data described herein as being transmitted by server machine 100*a* to client machine 100*b* or by client machine 100*b* to server machine 100*a* can be transmitted as datagrams according to the user datagram protocol (UDP), the transmission control protocol (TCP), or another protocol.

The computer-network 116 may include any of a variety of network topologies and network devices, and may employ traditional network-related technologies, including for example the public switched telephone network, cable networks, cellular wireless networks, WiFi, and WiMAX. Further, the computer-network 116 may include one or more databases (e.g., a player credit account database), to allow for the storing and retrieving of data related to performing an outcome event by a machine, as well as adjusting account balances associated with client machines.

For purposes of this description, any operation listed in a sentence including the words the "machine 100 can cause," the "server machine 100*a* can cause," or the "client machine 100*b* can cause" can be carried out, at least in part, as a result of that particular machine executing software program instructions. Those software program instructions can be stored within data storage 114, 114*a*, or 114*b*.

Figure 5:
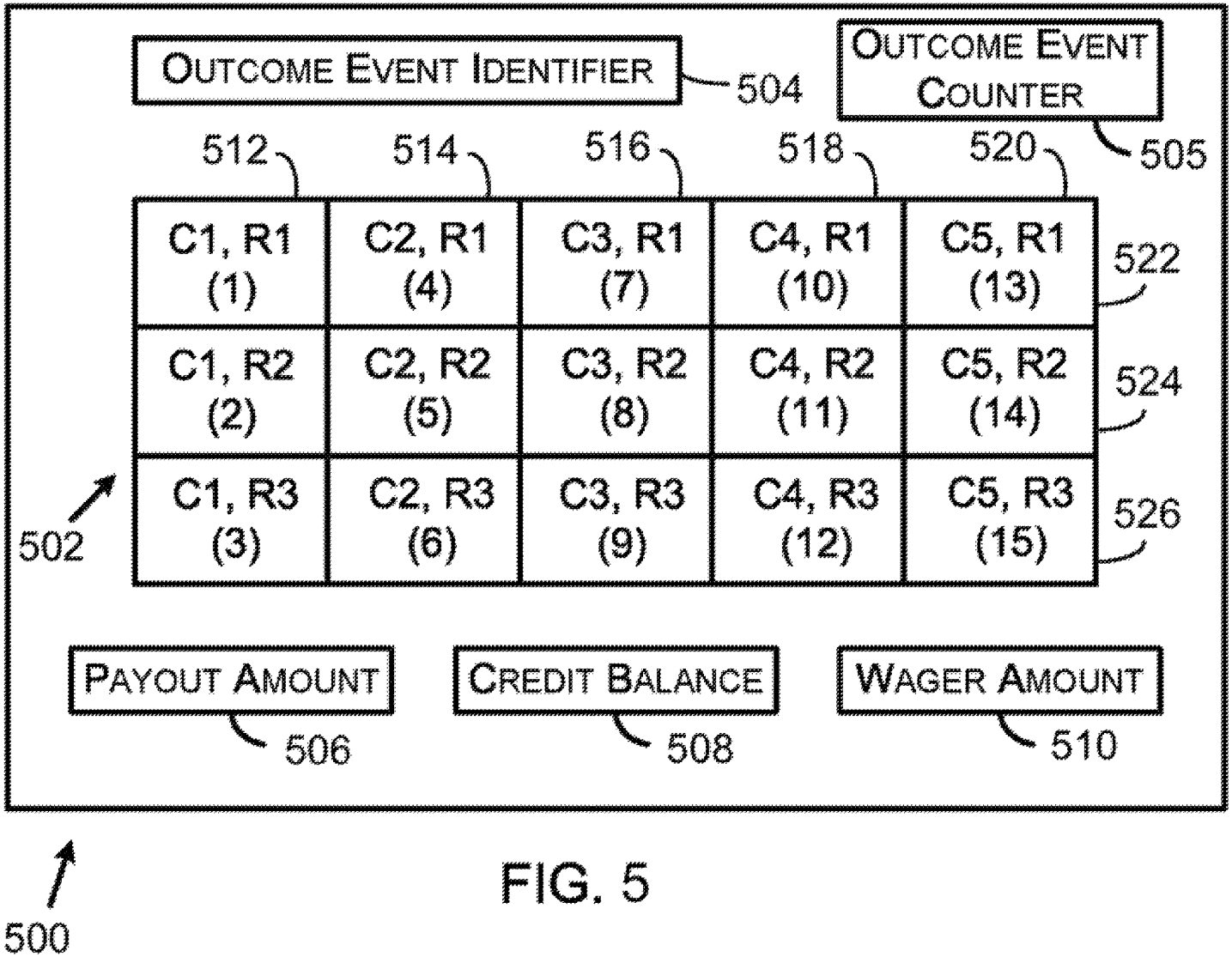
FIG. 5 depicts elements displayable by a display of a machine, in accordance with example embodiments.

Next, FIG. 5 depicts a screenshot 500 that machine 100, server machine 100*a*, or client machine 100*b* can visually present (i.e., display) using displays 110, 110*a*, and 110*b*, respectively. For purposes of this description, each element of screenshot 500 can be a displayable element of the display. Screenshot 500 includes a symbol-display-portion 502, an outcome event identifier 504, an outcome event counter 505, a payout amount indicator 506, a credit balance indicator 508, and a wager amount indicator 510.

Symbol-display-portion 502 can include multiple symbol-display-segments and multiple symbol positions. As an example, the symbol-display-segments can include vertical symbol-display-segments 512, 514, 516, 518, and 520 (or more simply, vertical SDS 512-520). As another example, the symbol-display-segments can include horizontal symbol-display-segments 522, 524, and 526 (or more simply, horizontal SDS 522-526). Each symbol-display-segment can include multiple symbol positions. The vertical SDS 512-520 are shown in FIG. 5 as having three symbol positions. The horizontal SDS 522-526 are shown in FIG. 5 as having five symbol positions. A person skilled in the art will understand that those symbol-display-segments can be configured with different numbers of symbol positions than shown in FIG. 5.

The vertical SDS 512-520 can be configured as spinnable reels. The processor of a machine or system displaying screenshot 500 can display the spinnable reels spinning and stopped after spinning. For vertical SDS 512-520, the spinnable reels may spin in a vertical direction (e.g., top to bottom or bottom to top, with respect to the symbol-display-portion 502).

The horizontal SDS 522-526 can be configured as spinnable reels. The processor of a machine or system displaying screenshot 500 can display the spinnable reels spinning and stopped after spinning. For horizontal SDS 522-526, the spinnable reels may spin in a horizontal direction (e.g., left to right or right to left, with respect to the symbol-display-portion 502).

The multiple symbol positions in symbol-display-portion 502 are identified by column and row designators, in which C1=column 1, C2=column 2, C3=column 3, C4=column 4, C5=column 5, R1=row 1, R2=row 2, and R3=row 3. The multiple symbol positions in symbol-display-portion 502 are also identified by distinct numerical identifiers shown within parenthesis. C1 can be a first SDS. C2 can be a second SDS. C3 can be a third SDS. C4 can be a fourth SDS. C5 can be a fifth SDS. As shown in FIG. 5, C2 is between C1 and C3, C3 is between C2 and C4, and C4 is between C3 and C5.

For a matrix arrangement with 15 symbol positions as shown in FIG. 5, the numerical identifiers can be whole numbers 1 through 15, inclusive. The processors or machines described herein can be configured to select a symbol position of symbol-display-portion 502 using a random number generator that is configured to generate a number within the range 1 through N, inclusive, where N equals the number of symbol positions in symbol-display-portion 502. For the matrix arrangement, each symbol-display-segment can be a distinct column of the multiple columns within the matrix. Alternatively, for the matrix arrangement, each symbol-display-segment can be a distinct row of the multiple rows within the matrix.

The processor of the machines or systems described herein can determine a state the machine or system is operating in or an outcome event that can occur during the determined state of the machine or system. In response to making that determination, the processor can cause the outcome event identifier 504 to display an identifier of the outcome event that can occur during the determined state. For example, the outcome event identifier can identify a base outcome event, a bonus outcome event or another type of outcome event. The bonus outcome event can be a "free spins" outcome event or some other outcome event.

The processor of the machines or systems described herein can determine a wager amount placed on an outcome event, a payout amount after or during occurrence of an outcome event resulting in a win, a credit balance after or while decreasing a number of credits based on placement of a wager or after or while increasing a number of credits based on a determined payout amount, and a number of awarded remaining outcome events that can occur. The processor can cause the determined wager amount to be displayed by the wager amount indicator 510, the determined payout amount to be displayed by the payout amount indicator 506, the determined credit balance to be displayed by the credit balance indicator 508, and the number of awarded remaining outcome events to be displayed by the outcome event counter 505.

III. Example Operations

FIG. 3A, FIG. 3B, FIG. 3C and FIG. 3D (i.e., FIGS. 3A-3D) depict a flowchart showing a set of operations 345 (or more simply, "the set 345") that can, for example, be carried out using machine 100. Nonetheless, some or all of these operations may be carried out on server machine 100*a* and/or client machine 100*b*.

The operations of the set 345 are shown within blocks labeled with even integers between 300 and 344, inclusive, and can pertain to a method in connection with machine 100. The example method can relate to performing outcome events, such as a wager game. Any other operation(s) described herein as being performed by machine 100 can be performed prior to, while, or after performing any one or more of the operations of the set 345, unless context clearly dictates otherwise. Those other operation(s) can be performed in combination with or separately from any one or more of the operations of the set 345. Any operation described below, or elsewhere in this description, with respect to FIGS. 3A, 3B, 3C and 3D, can be performed, at least in part, by a processor, such as processor 112 executing software program instructions.

Figure 3A:
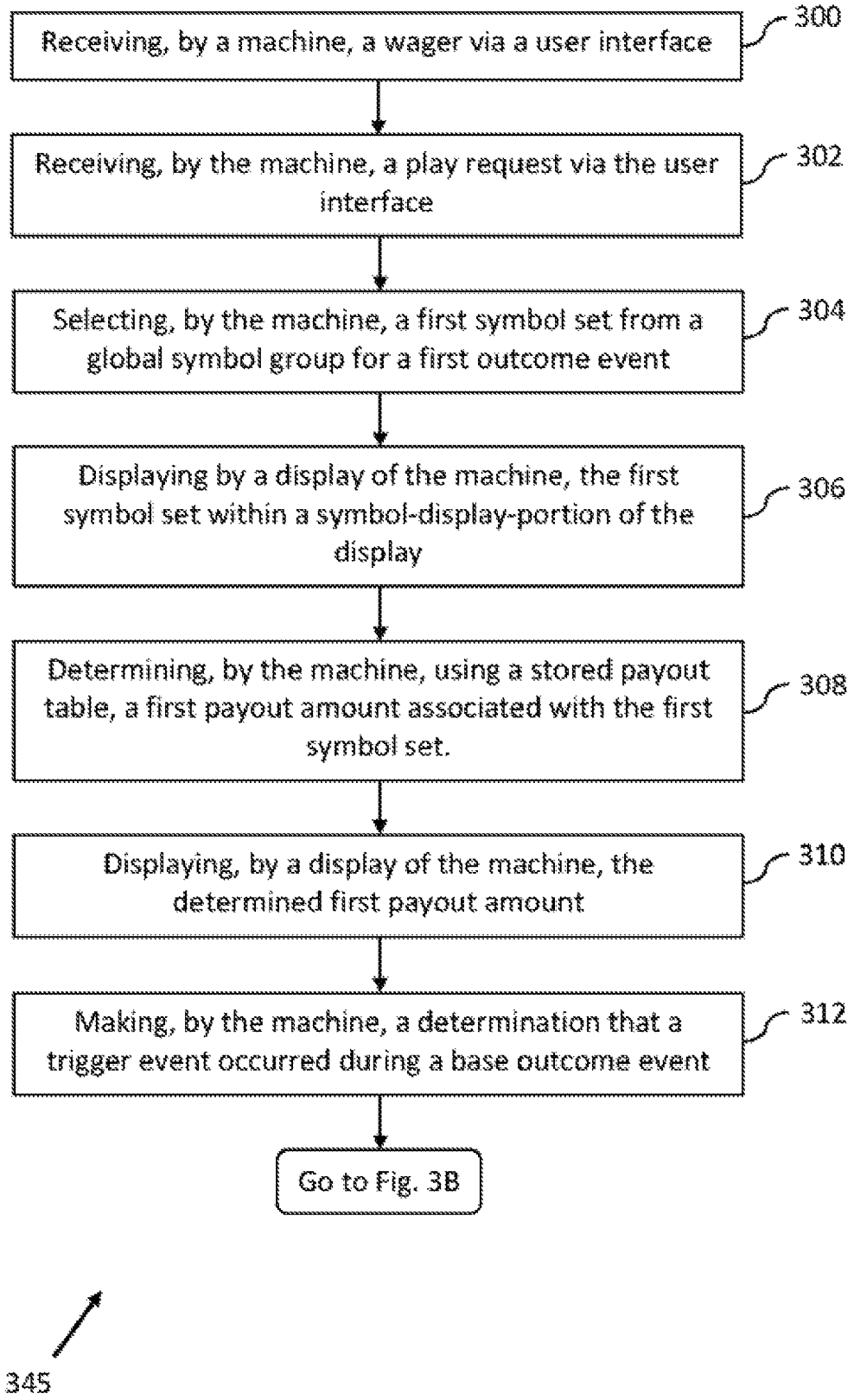
FIG. 3A is a first part of a flow chart, in accordance with example embodiments.

Turning to FIG. 3A, block 300 includes receiving, by machine 100, a wager via the user interface 104. In one example, this may allow a player to enter a wager (e.g., a wager amount) using a keypad of the user interface 104. The wager can be placed on an outcome event, such as, but not limited to, a base outcome event configured as a wager game. The received wager may or may not provide a user of the machine with an opportunity to earn (e.g., win) a payout. Since a received wager does not necessarily provide an opportunity to earn a payout, the received wager can be referred to as a payment. A base outcome event can be carried out after or in response to receiving a payment. Machine 100 can be configured such that a bonus outcome event can be carried out without receiving any additional payment after receiving a payment to carry out a base outcome event that results in an award of a predetermined number of bonus outcome events.

A player using machine 100 may have a corresponding player credit balance from which the entered wager may be deducted in response to the wager being entered or machine 100 receiving a play request from the player. For example, a player may have a player credit balance of 100,000 credits, which may be reduced to 99,750 credits upon the player requesting a play of the game with a wager of 250 credits. Additionally, or alternatively, the wager can be received by entry of a token, coin, or paper bill into the user interface 104 or by sliding or inserting a payment card, such as a credit or debit card, into the user interface 104. Machine 100 can cause display 110 to display wager information such as, but not limited to, a player credit balance on the credit balance indicator 508, possible wager amounts in wager amount indicator 510, and a received wager amount in wager amount indicator 510.

Next, block 302 includes receiving, by machine 100, a play request (e.g., a "spin" request) via the user interface 104. Receiving the play request can include or allow a player to pull a lever or push a button on machine 100 to initiate occurrence of an outcome event or to request a play of the wager game. Receiving the play request can result in the player's credit balance being reduced by an amount of the player's wager or a payment to carry out the outcome event.

Next, block 304 includes determining, by machine 100, a first symbol set to display within the symbol-display-portion 502 of display 110 for the outcome event. Determining the first symbol set can include processor 112 carrying out a random selection, such as a random selection of the first symbol set from a global symbol group.

Figure 6:
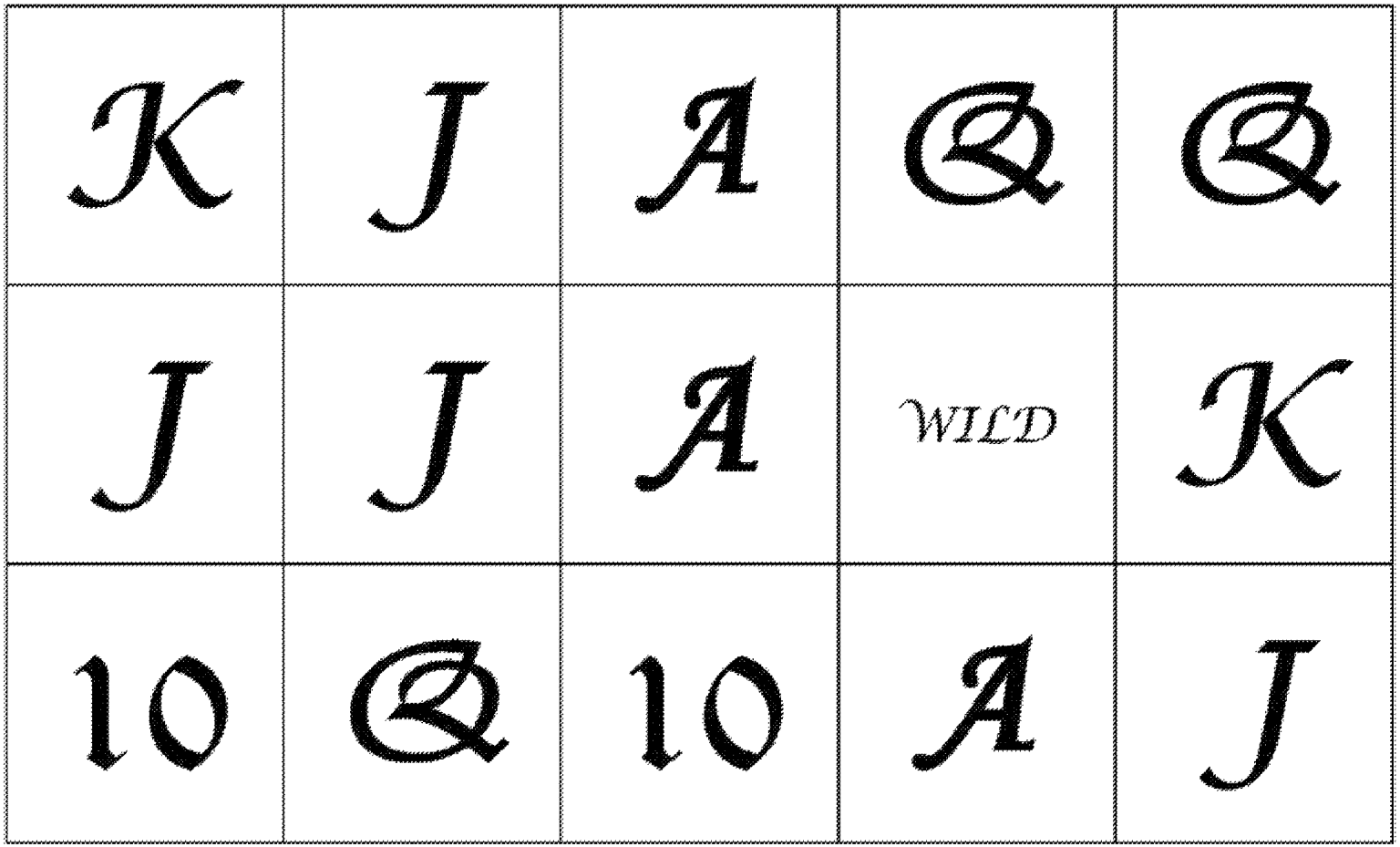
FIG. 6 depicts an example of a selected first symbol set in a display, in accordance with example embodiments.

The global symbol group can include multiple symbols, such as a Wild, an Ace, a King, a Queen, a Jack and a Ten that may be used in connection with the outcome event, such as a wager game. The Ace, King, Queen, Jack and Ten symbols can represent symbols found on a standard deck of playing cards. FIG. 6 depicts examples of the aforementioned symbols and examples of other symbols that can be a part of the global symbol group. The global symbol group may be customized with particular symbols as desired.

Figure 4:
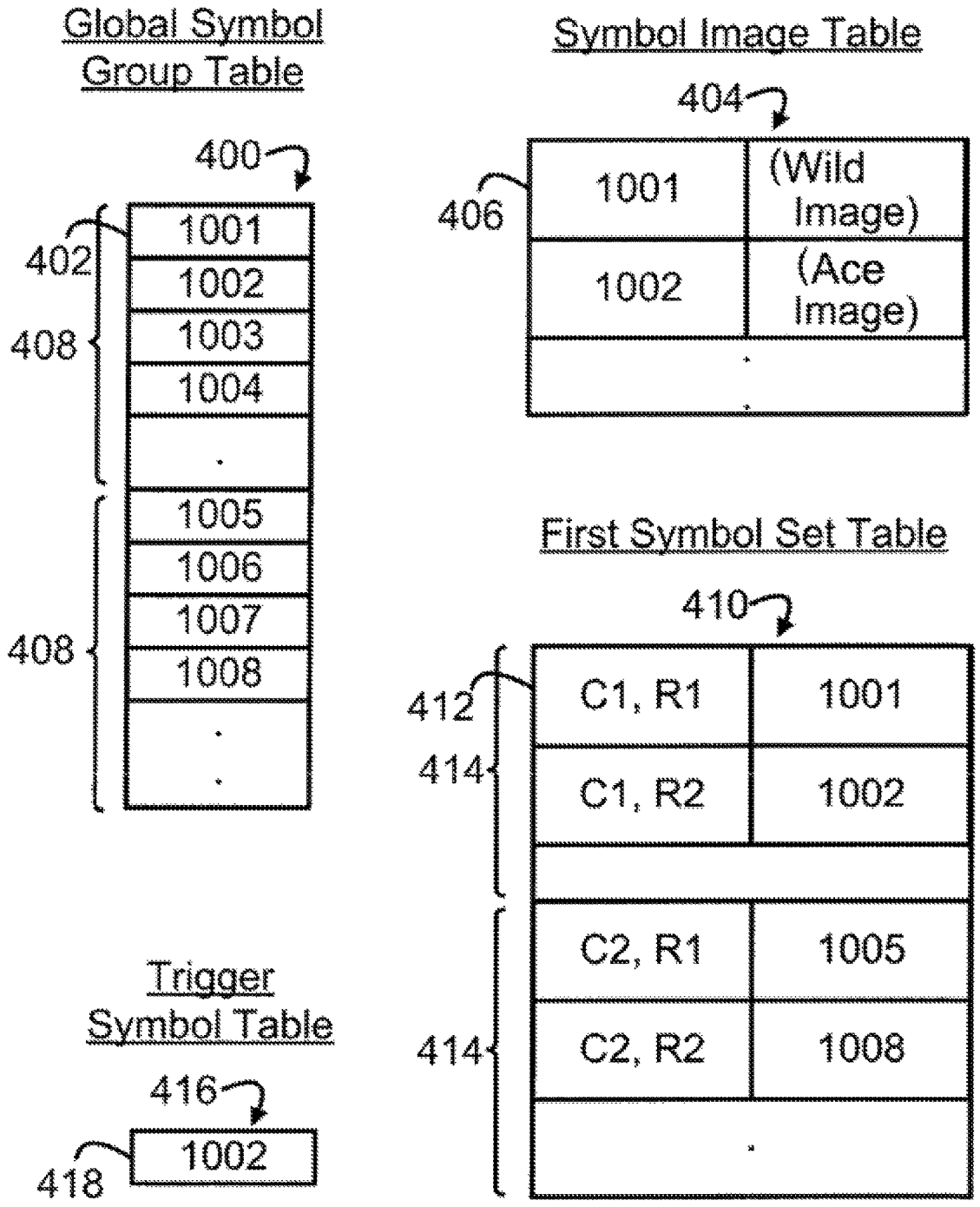
FIG. 4 depicts diagrams of tables that may be used with the processes, machines, and systems herein, in accordance with example embodiments.

In one example, the global symbol group may be represented as a table (or other data structure) stored in data storage 114. FIG. 4 shows an example global symbol group table 400. The global symbol group table 400 includes multiple records 402, each including an identifier (e.g., 1001, 1002, 1003 1004, etc.) that represents a particular symbol. In one example, the global symbol group, and therefore the global symbol table 400, may be divided into multiple sub-groups 408 as discussed in greater detail below.

The global symbol group table 400 may be used in connection with a symbol image table 404. The symbol image table 404 includes multiple records 406 (shown as distinct rows of table 404), each including an identifier that represents a particular symbol, and a corresponding displayable image. As such, the symbol image table 404 may be used to map an identifier in the global symbol group table 400 to a displayable image.

The selected first symbol set may be represented by a first symbol set table 410. The first symbol set table 410 includes multiple records 412 (shown as distinct rows in table 410), each record including an arrangement position of the symbol, and an identifier that represents the symbol. As such, each symbol in the selected first symbol set may correspond with a respective arrangement position in an arrangement (e.g. both a column number and a row number in a column-and-row arrangement). As an example, C1, R1, shown in the first symbol set table 410, represents a symbol position at column 1 (e.g., a left-most column of a plurality of columns in a symbol-display-portion 502 of display 110) and row 1 (e.g., a top row of a plurality of rows in a symbol-display-portion 502 of display 110). The column identifiers in table 410 (e.g., C1 and C2) can refer to columns in a symbol matrix or reels of a plurality of reels that can be spun.

In one example, machine 100 may select the first symbol set by iterating through each record 412 in the first symbol set table 410, and selecting a symbol identifier from among the symbol identifiers in the global symbol group table 400. In one example the symbol identifiers are numbers and machine 100 uses a random number generator to select such numbers, and therefore to randomly select symbols.

In one example, machine 100 may select each subset in the first symbol set from the corresponding sub-group in the global symbol group. This type of selection may be used when the symbol set represents one or more reels in a reel-type wager game. In this instance, each sub-group includes all the symbols of a given reel, and the selected sub-set includes the symbols of the reel that are "in play", namely those included in the selected first symbol set.

In one example, the first symbol set may be partially restricted. For instance, the first symbol set may include an instance of a predetermined symbol from the global symbol group, for example, a Wild symbol. In another example, the predetermined symbol may be in a subgroup of global symbol group table 400 distinct from the subgroups from which symbols for the reels are selected.

As noted above, for each symbol in the selected first symbol set, the example embodiments can include machine 100 randomly determining a corresponding arrangement position. As such, in an example where the arrangement is a column-and-row arrangement, machine 100 may randomly determine a column identifier and a row identifier (from a set of potential column identifier and row identifier combinations) for each symbol in the selected first symbol set. In an example where the arrangement has symbol position identifiers (e.g., whole number 1 through 15, inclusive, as described above), machine 100 may randomly select a symbol position identifier for each symbol in the selected first symbol set.

Where the column and row arrangement is used to simulate reels, machine 100 may display the each subset in a corresponding column, such as by superimposing each subset over a virtual reel in a corresponding column. Further, a sub-group 408 may represent an ordering of symbols on a particular reel.

Returning to FIG. 3A, block 306 includes displaying, by the machine 100 on the symbol-display-portion of the display 110, the selected first symbol set.

Next, block 308 includes determining, by machine 100, using a stored payout table (not shown), a first payout amount, where the first payout amount is a function of the selected first symbol set and the received wager. Processor 112 can execute program instructions to determine whether a payout is earned (e.g., won) as a result of each outcome event occurring at machine 100. If a payout is not earned, the payout amount can be zero. If a payout is earned, the payout amount can be a function of the received wager and the symbol set selected for the outcome event (e.g., the first symbol set selected for the first outcome event) or the corresponding arrangements of symbols in the selected first symbol set.

Next, block 310, includes displaying, by display 110 of machine 100, the determined first payout amount. For example, where machine 100 has determined, using the stored payout table, a first payout amount of 500 credits, machine 100 may display on display 110 the determined payout amount of 500 credits. Additionally or alternatively, machine 100 may add the determined payout amount to the player credit balance and display the updated player credit balance. For instance, where the player credit balance was 99,750 credits before the payout amount was determined, machine 100 may add the determined payout amount of 500 credits to the player credit balance so that the updated balance is 100,250 credits. Furthermore, machine 100 can cause display 110 to display a count-up from a first balance amount (e.g., 99,750 credits) to a second balance amount (e.g., 100,250 credits), where the second balance amount equals a sum of the first balance amount and the determined payout amount.

In one example, machine 100 may also physically dispense a corresponding payout (e.g., cash), or otherwise facilitate the payout to the player (by adding funds to an electronic account associated with a gaming card). Additionally or alternatively to determining the payout amount, machine 100 may perform other actions to award the player. For instance, the machine may display an indication of a tangible prize. Other types of awards may be used as well.

FIG. 6 shows an example of a first symbol set 600 from the global symbol group for display during a base outcome event. The displayed first symbol set 600 includes (i) a single Wild symbol at arrangement position C4,R2; (ii) three Ace symbols at arrangement positions C3,R1 and C3,R2 and C4,R3; (iii) a pair of King symbols at arrangement positions C1,R1 and C5,R2; (iv) three Queen symbols at arrangement positions C4,R1 and C5,R1 and C2,R3; (v) four Jack symbols at arrangement positions C2,R1 and C1,R2 and C2,R2 and C5,R3; and (vi) two Ten symbols at arrangement positions C1,R3 and C3,R3.

Next, block 312 includes making, by machine 100, a determination that a trigger event occurred. The trigger event can be a randomly occurring event, such as an event that randomly occurs during performance of at least some base outcome events. For example, occurrence of the trigger event can include the presence of at least one trigger symbol in the first symbol set, such as in connection with a previous play of the game (e.g., a base outcome event). Similar to the selection of the first symbol set, in one example, machine 100 may use a random number generator to select the trigger symbol from the global symbol group. In another example, the trigger symbol may be non-randomly selected, such as selecting by a user (e.g. a player, machine designer or casino personnel). In another example, the trigger symbol may be predetermined, for example a Wild symbol.

Making the determination that the trigger event occurred can take place while machine 100 operates in a first machine state (or more simply, the first state). Machine 100 can be configured such that, while machine 100 is operating in the first state, machine 100 allows the player to play base outcome events in which sets of symbols selected from a global symbol group can be selected by processor 112 and displayed by display 110.

Figure 3B:
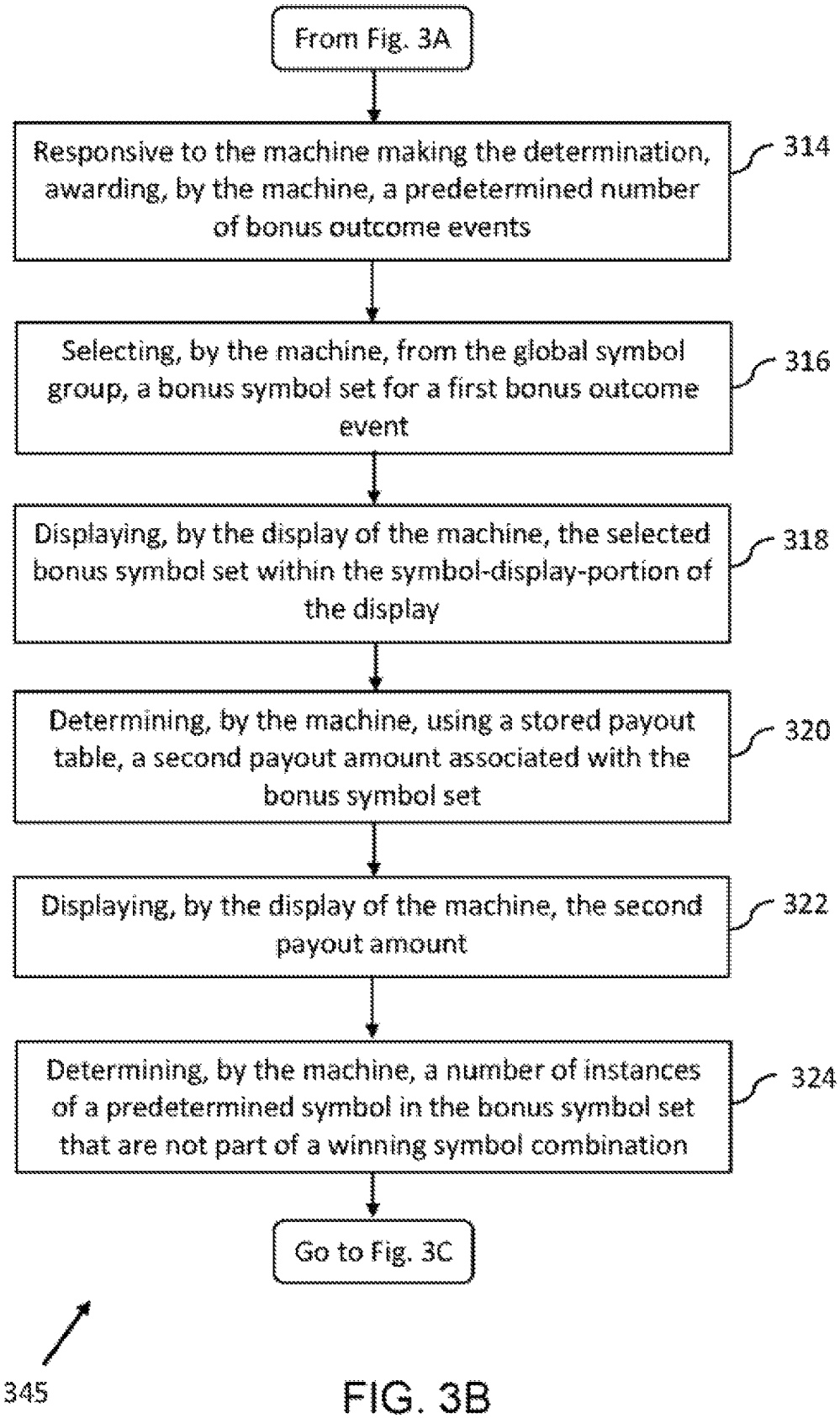
FIG. 3B is a second part of the flow chart of FIG. 3A, in accordance with example embodiments.

Turning to FIG. 3B, block 314 includes, responsive to machine 100 making the determination (i.e., the determination made at block 312), awarding, by machine 100, a bonus feature of the game. For example, the bonus feature may be a predetermined number of consecutive plays (e.g., spins and/or patterns of symbols being displayed) of outcome events. The awarded outcome events can be bonus outcome events, such as a game or a wager game. The predetermined number of consecutive outcome events can be conditioned upon a combination of symbols displayed by display 110 as a result of playing a base outcome event. Machine 100 can cause outcome event identifier 504 to identify the bonus outcome event awarded (e.g., a "free spins" bonus) and to cause the outcome event counter 505 to display the predetermined number.

Furthermore, in response to making the determination at block 312, machine 100 can transition from operating in the first state to operating in a second machine state (or more simply, the second state). Machine 100 can be configured such that, while machine 100 is operating in the second state, machine 100 allows the player to play bonus outcome events in which sets of symbols selected from a global symbol group can be selected by processor 112 and displayed by display 110. In accordance with an embodiment in which the symbol-display-portion includes 15 symbol positions, selecting a set of symbols for a bonus outcome event can include selecting 15 symbols.

Machine 100 can be configured to transition from operating in the second state back to operating in the first state. This transition can occur in response to machine 100 determining any of a variety of trigger events, such as, but not limited to, occurrence of all of the awarded predetermined number of consecutive plays of the outcome event, or a player stopping play of machine 100 while one or more of the awarded predetermined number of consecutive plays of the outcome event remain to occur. Machine 100 can be configured to store a number indicating any remaining consecutive plays of the outcome event and to allow a player awarded the consecutive plays to commence playing any remaining consecutive plays of the outcome event at a time after the player stops performing (e.g., playing) the outcome events.

Next, block 316 includes selecting, by the machine 100, from the global symbol group, a bonus symbol set for a first base outcome event.

Figure 7:
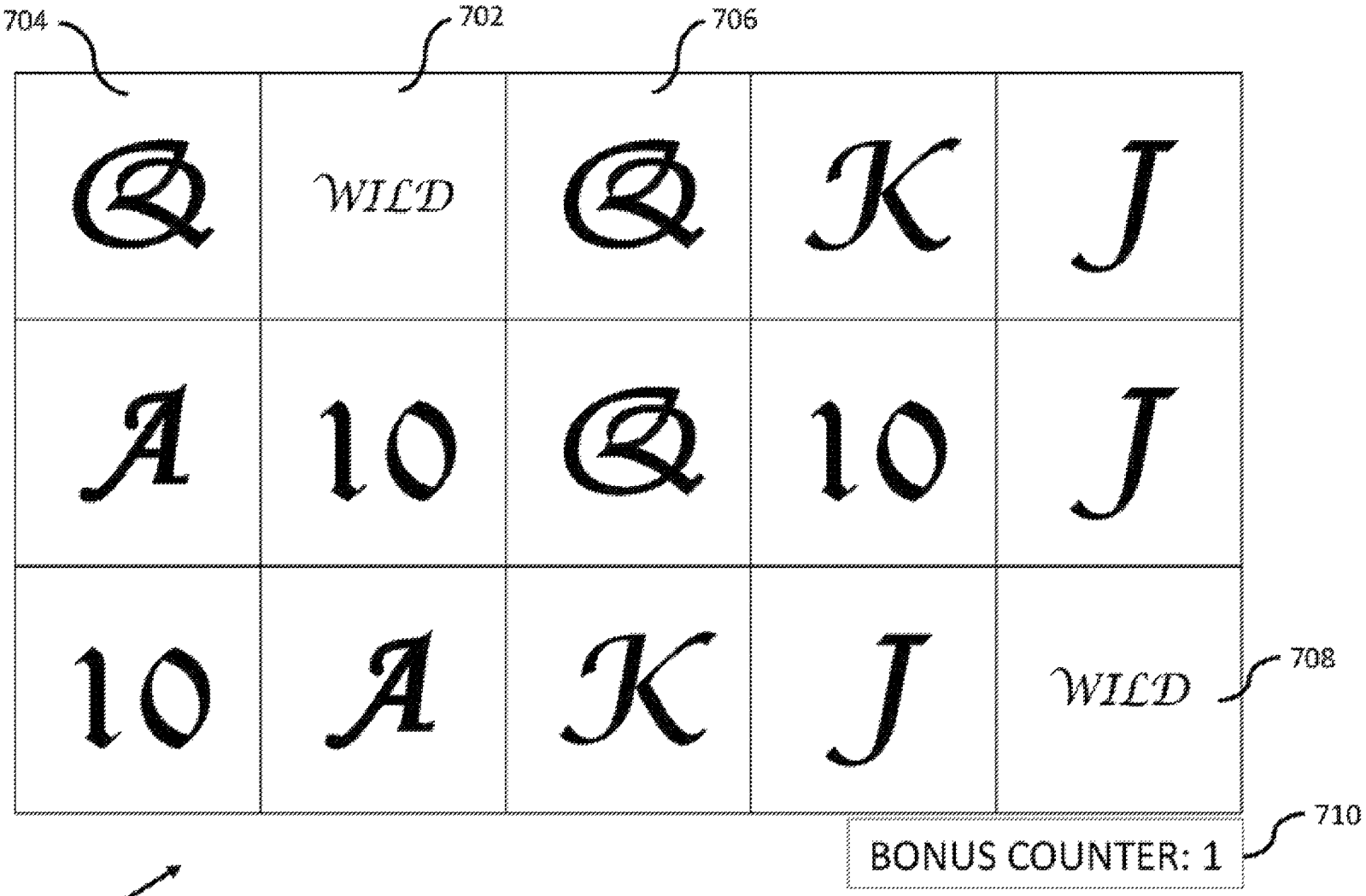
FIG. 7 depicts an example of a selected bonus symbol set in a display, in accordance with example embodiments.

Next, block 318 includes, displaying, by the machine 100 on the symbol-display-portion of the display 110, the selected bonus symbol set. FIG. 7 shows an example of such a bonus symbol set selected from the global symbol group. The bonus symbol set 700 consists of (i) two Wild symbols at arrangement positions C2,R1 and C5,R3; (ii) two Ace symbols at arrangement positions C1,R2 and C2,R3; (iii) two King symbols at arrangement positions C4,R1 and C3,R3; (iv) three Queen symbols at arrangement positions C1,R1 and C3,R1 and C3,R2; (v) three Jack symbols at arrangement positions C5,R1 and C5,R2 and C4,R3; and (vi) three Ten symbols at arrangement positions C2,R2 and C4,R2 and C1,R3.

Next, block 320 includes determining, by machine 100, a second payout amount. In one example, the second payout amount may be determined by the machine 100 using a stored payout table (not shown) as a function of the received wager and the symbols in the displayed bonus symbol set.

Next, block 322 includes displaying, on the display 110, the determined second payout amount. In one example, the machine 100 may also physically dispense a corresponding payout amount (e.g., cash), or otherwise facilitate the payout to the player (by adding funds to an electronic account associated with a gaming card).

Next, block 324 includes determining, by machine 100, a number of instances of a predetermined symbol in the displayed bonus symbol set that do not form part of a winning symbol combination (i.e., a symbol combination that qualifies for a payout).

Figure 3C:
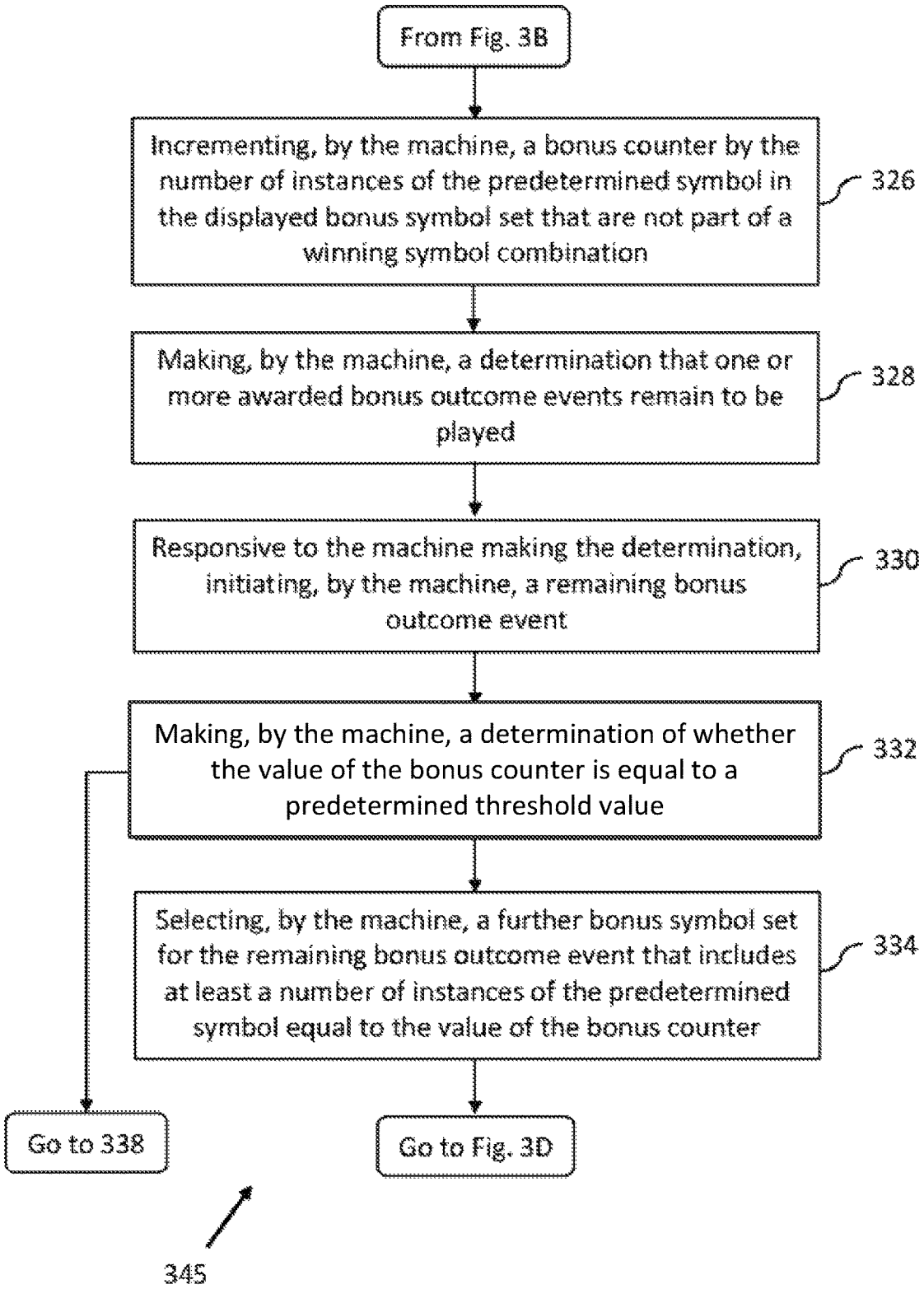
FIG. 3C is a third part of the flow chart of FIG. 3A, in accordance with example embodiments.

Turning to FIG. 3C, block 326 includes incrementing, by the machine 100, a symbol counter by the number of instances of the predetermined symbol in the displayed bonus symbol set that do not form part of a winning symbol combination. In one example, the symbol counter may be stored within data storage 114.

Next, block 328 includes making, by machine 100 (e.g., processor 112), a determination that one or more of the awarded bonus outcome events remain to be played. In that regard, processor 112 may determine that one or more awarded bonus outcome events have not occurred by referring to data within data storage 114 that is displayed at bonus outcome event counter 505 shown in FIG. 5. An awarded bonus outcome event that has not yet occurred can be referred to as a "remaining bonus outcome event".

Next, block 330 includes, pursuant to making the determination (i.e., the determination of block 328), initiating, by machine 100, a remaining bonus outcome event. Initiating the remaining bonus outcome event can include selecting a bonus symbol set to display within the symbol-display-portion 116 of display 100.

Next, block 332 includes making a determination of whether the value of the symbol counter is equal to a predetermined threshold value.

Next, block 334 includes, pursuant to determining that the value of the symbol counter is equal to the predetermined threshold value (i.e., the determination in block 332), selecting, by the machine 100, from the global symbol group, a further bonus symbol set for the remaining bonus outcome event, that includes at least a number of instances of the predetermined symbol equal to the value of the bonus counter.

Figure 3D:
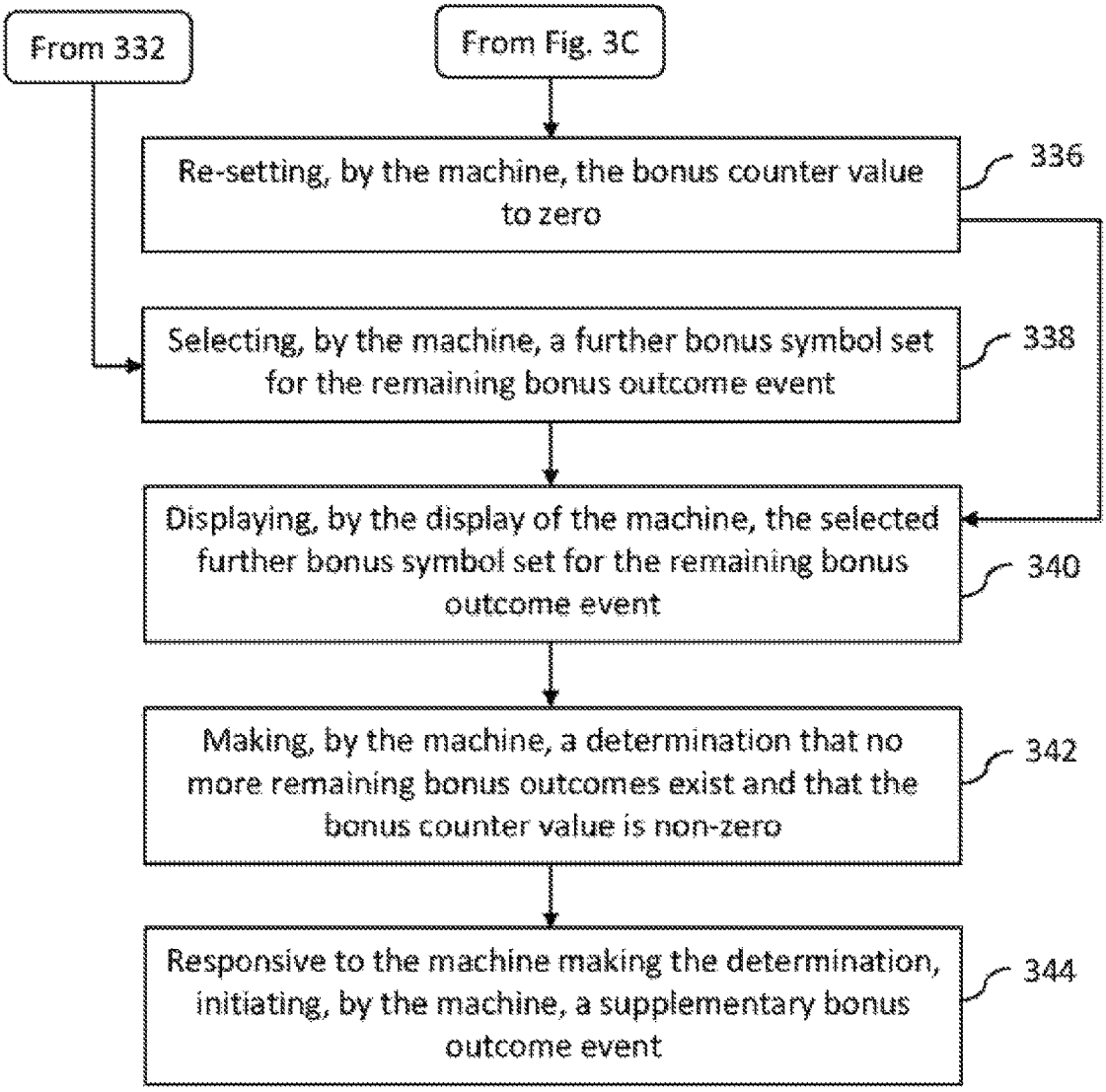
FIG. 3D is the fourth part of the flow chart of FIG. 3A, in accordance with example embodiments.

Turning to FIG. 3D, block 336 includes resetting, by machine 100, the symbol counter value to zero.

Next, block 338 includes, pursuant to determining that the value of the bonus counter is not equal to the predetermined threshold value (i.e., the determination in block 332), selecting, by the machine 100, from the global symbol group, a further bonus symbol set for the remaining bonus outcome event.

Next, block 340 includes displaying, by the machine 100 on the symbol-display-portion of the display 110, the selected further bonus symbol set.

Next, block 342 includes making, by machine 100, a determination that no more remaining bonus outcome events exist and that the bonus counter value is non-zero.

Next, block 344 includes, pursuant to making the determination (i.e., the determination in block 342), initiating, by machine 100, a supplementary bonus outcome event.

Functions of the set 345 can repeat to carry out each remaining bonus outcome event in response to machine 111 making the determinations of blocks 328 or 342.

In one example, the predetermined symbol may be a Wild symbol.

Wild symbol 702 and the two Queen symbols 704 and 706 in the bonus symbol set 700 represented in FIG. 7 form part of a winning symbol combination, i.e., three Queen symbols since Wild symbol 702 can substitute for any other symbol in the global symbol group. Wild symbol 708, however, does not form part of a winning symbol combination. As the bonus symbol set 700 includes a single Wild symbol that is not part of a winning symbol combination, bonus counter 710 is incremented from an initial value of 0 to a value of 1.

Figure 8:
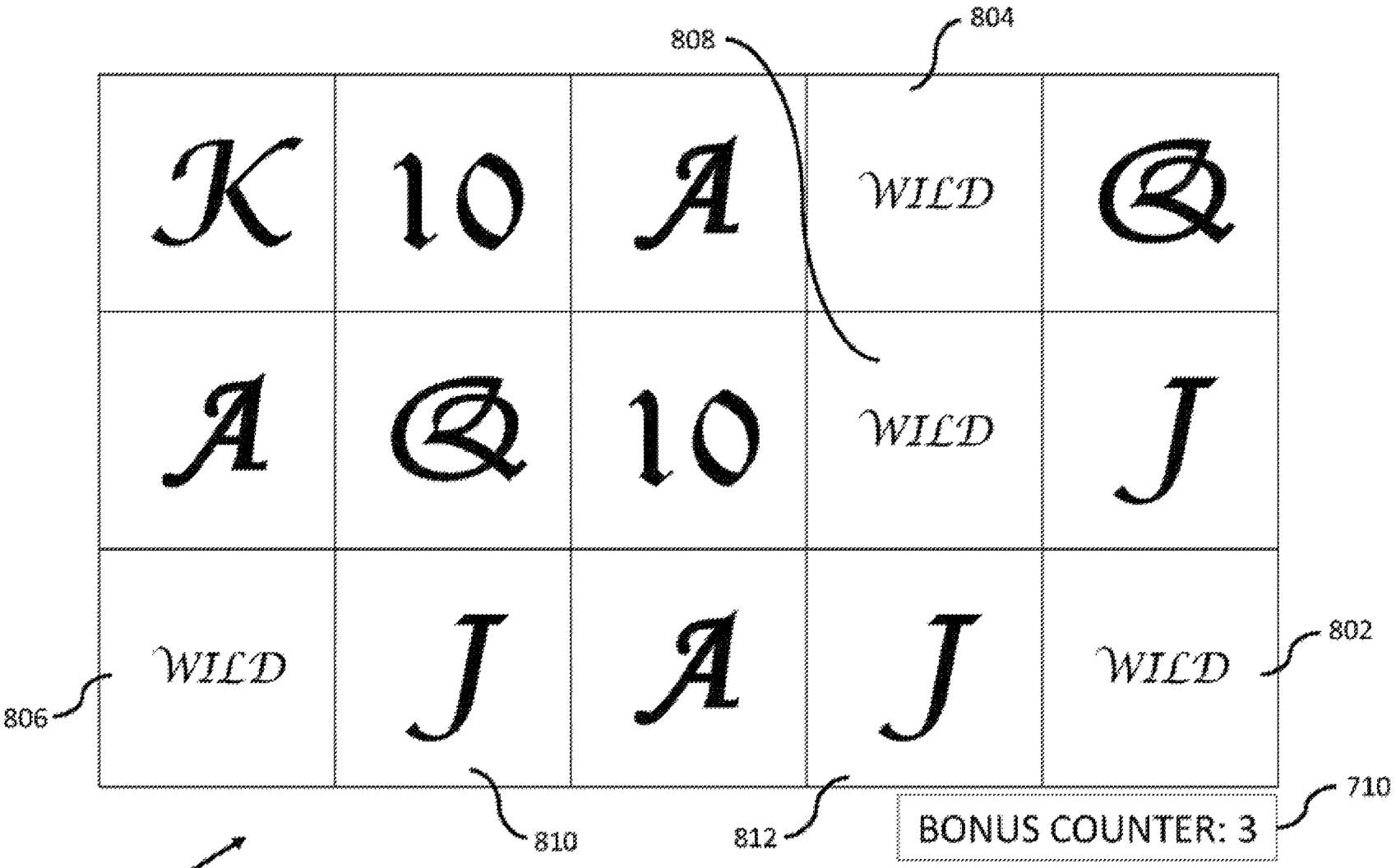
FIG. 8 depicts an example of another selected bonus symbol set in a display, in accordance with example embodiments.

FIG. 8 shows an example of another bonus symbol set 800 selected from the global symbol group for displaying during a remaining (e.g., a next) bonus outcome event occurring after the outcome event represented in FIG. 7. As described above, the remaining outcome events discussed with respect to FIG. 8 can be initiated pursuant to machine 100 making a determination that one or more of the awarded bonus outcome events have not yet occurred (i.e., remain to occur).

Bonus symbol set 800 includes four Wild symbols 802, 804, 806 and 808 at respective arrangement positions C5,R3 and C4,R1 and C1,R3 and C4,R2. All the Wild symbols 802, 804, 806 and 808 have been newly-selected as part of the symbol set 800.

Wild symbols 802 and 806, together with the two Jack symbols 810 and 812 in the bonus symbol set represented in FIG. 8 form part of a winning symbol combination, i.e., four Jack symbols since Wild symbols 802 and 806 can substitute for any other symbol in the global symbol group. Wild symbols 804 and 808, however, are not part of any winning symbol combination. As the bonus symbol set 800 includes two Wild symbols that are not part of a winning symbol combination, bonus counter 710 is incremented from a previous value of 1 (as represented in FIG. 7) to a new value of 3.

In one example, the predetermined threshold value of the bonus counter is 3.

Figure 9:
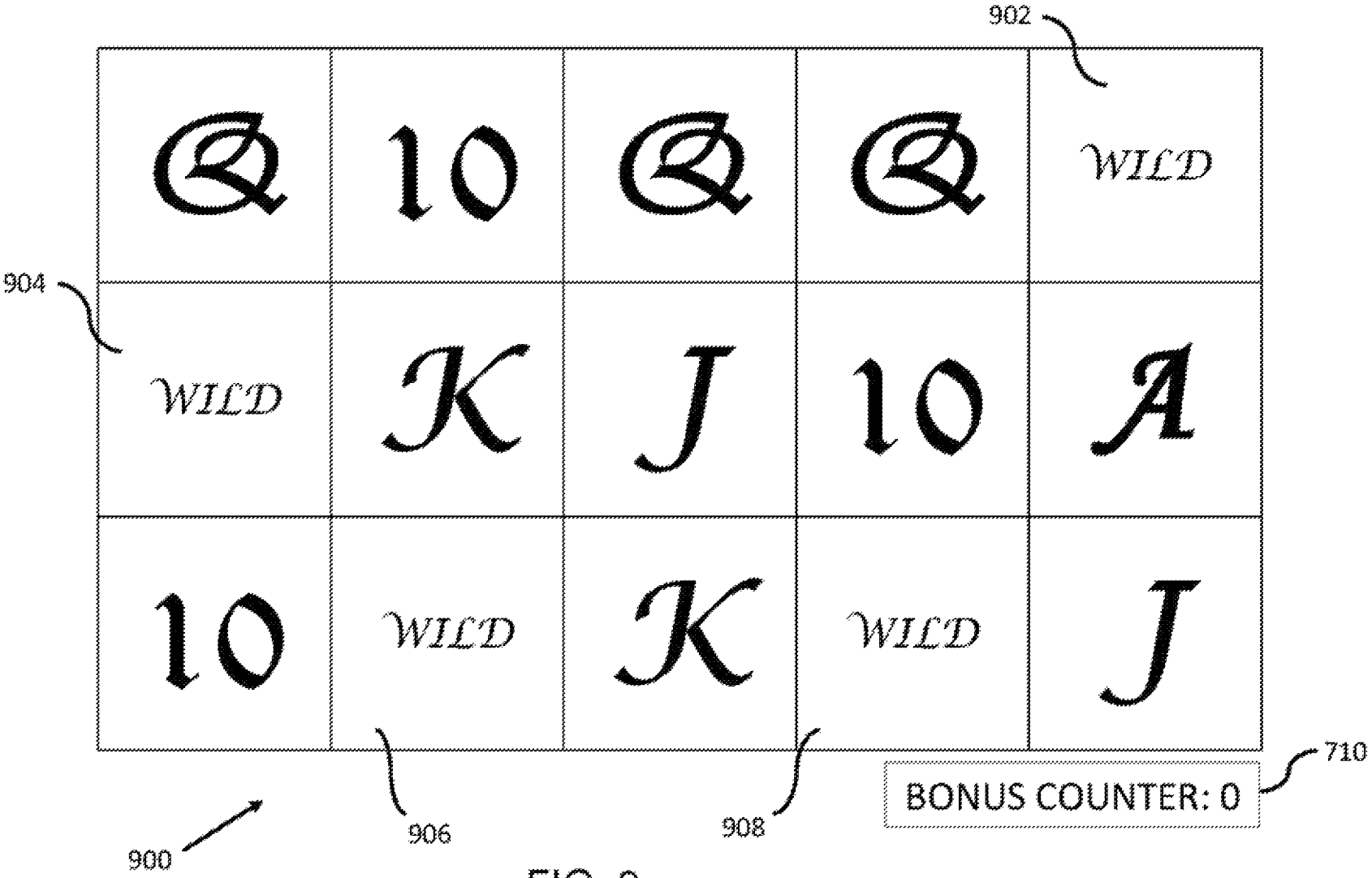
FIG. 9 depicts an example of another selected bonus symbol set in a display, in accordance with example embodiments.

FIG. 9 shows an example of another bonus symbol set 900 selected from the global symbol group for displaying during a remaining (e.g., a next) bonus outcome event represented in FIG. 8. As described above, the remaining outcome events discussed with respect to FIG. 9 can be initiated pursuant to machine 100 making a determination that one or more of the awarded bonus outcome events have not yet occurred (i.e., remain to occur).

Bonus symbol set 900 includes four Wild symbols 902, 904, 906 and 908 at respective arrangement positions C5,R1 and C1,R2 and C2,R3 and C4,R3. The value of the bonus counter (i.e., the value 3) after completion of the bonus outcome event represented in FIG. 9 is equal to the predetermined value of the bonus counter. Three of the Wild symbols are instances of the Wild symbol arising from (i.e., "carried over") from previous bonus outcome events, while the remaining Wild symbol has been newly-selected as part of the symbol set 900.

The bonus counter 710 in FIG. 9 has been reset to zero.

If, upon completion of all the awarded bonus outcome events, the value of the bonus counter is non-zero, processor 112 may initiate a supplementary bonus outcome event. The value of the bonus counter may be incremented by the number of instances of the predetermined symbol that arise in the bonus symbol set selected during the supplementary bonus outcome event. If, at the end of the supplementary bonus outcome event, the value of the bonus counter is again non-zero, processor 112 may initiate a further supplementary bonus outcome event as above. Processor 112 may continue to initiate such further bonus outcome events until the value of the bonus counter becomes equal to the predetermined threshold value and is subsequently reset to zero.

Machine 100 can cause symbol-display-segments to spin, and to cause spinning symbol-display-segments to stop spinning. The spinning and stopping of the spinning symbol-display-segments can be carried out for each outcome event. In accordance with the embodiments in which the symbol-display-portion 502 includes columns or reels that spin from top to bottom or bottom to top, spinning the reels can include starting the spinning from a left-most column or reel to a right-most column or reel. Stopping the reels can occur using a similar sequence. Other sequences of spinning and stopping the spinning can be used. Moreover, the spinning or stopping of spinning of two or more columns or reels could occur simultaneously.

Notably, the operations of replacing, reordering, adding, and/or removing symbols from a reel of a reel-based game (e.g., the operations of blocks 318, 920, and 1020 as just some possible examples), necessitate computer implementation. In a mechanical reel-based game, the symbols appearing on each reel are fixed and cannot be changed mid-game. In contrast, the computer implementation herein allows the number of symbols per reel to be changed, as well as the symbols appearing on each reel to be replaced and/or re-ordered. These changes can occur mid-game, for example between spins of the reels. Consequently, these features of the disclosure herein would not exist but for computer technology.

Further, these features are an improvement to reel-based gaming technology. Since the symbols appearing on each reel are fixed and cannot be changed mid-game in mechanical reel-based games, the operations of replacing, reordering, adding, and/or removing symbols from a reel could not appear in such games. Due to this technological limitation, players may become disinterested in these basic reel-based games. Computer implementation, however, facilitates the integration of these features into reel-based games, resulting in game dynamics that would otherwise be unavailable. Consequently, the disclosure herein is a technological improvement to reel-based games.

IV. Additional Example Operations

FIGS. 10A-10D depict a flowchart showing a set of operations 1000 (or more simply, "the set 1000") that can, for example, be carried out using server machine 100*a*. Note that several of the operations described in connection with FIG. 10A-10D parallel operations described in connection with FIG. 3A-3D. As such, variations of the operations described in connection with FIG. 3A-3D are likewise applicable to the operations described in connection with Figures FIG. 10A-10D. However, for the sake of brevity, these variations are not repeated. The server machine 100*a*, in performing the set 1000, can perform the operations described above with respect to machine 100.

Figure 10A:
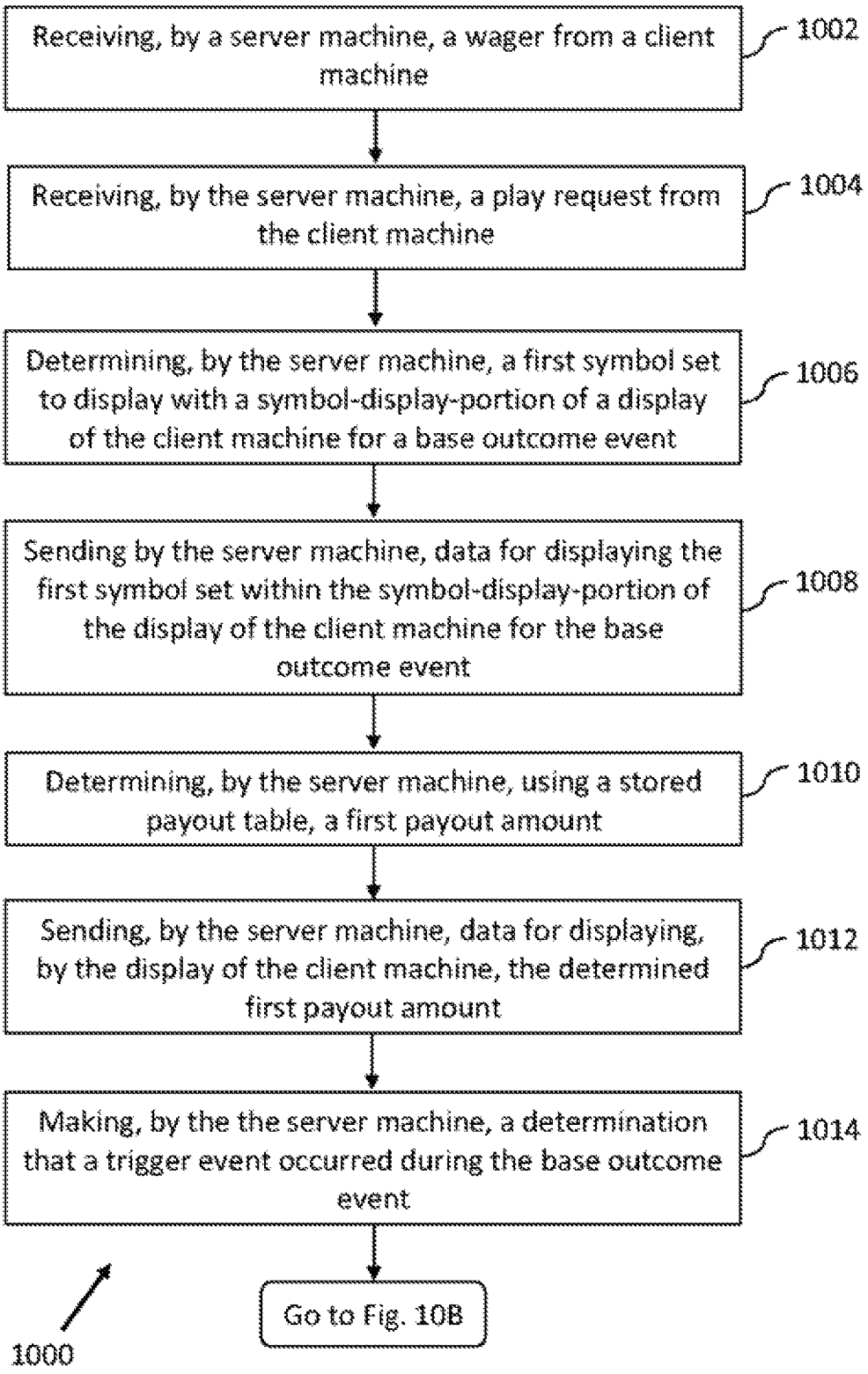
FIG. 10A is a first part of a flow chart, in accordance with example embodiments.

Turning to FIG. 10A, block 1002 includes receiving, by the server machine 100*a*, a wager from the client machine 100*b*.

Next, block 1004 includes receiving, by the server machine 100*a*, a play request from the client machine 100*b*.

Next, block 1006 includes determining, by the server machine 100*a*, a first symbol set to display within the symbol-display-portion of the display 110*b* of the client machine 100*b* for a base outcome event.

Next, block 1008 includes sending, by the server machine 100*a*, data for displaying, by the display 110*b* of the client machine 100*b*, the first symbol set within the symbol-display-portion of the display.

Next, block 1010 includes determining, by the server machine 100*a* using a stored payout table, a first payout amount associated with the first symbol set.

Next, block 1012 includes sending, by the server machine 100*a*, data for displaying, by the display 110*b* of the client machine 100*b*, the determined first payout amount.

Next, block 1014 includes making, by the server machine 100*a*, a determination that a trigger event occurred during the base outcome event.

Figure 10B:
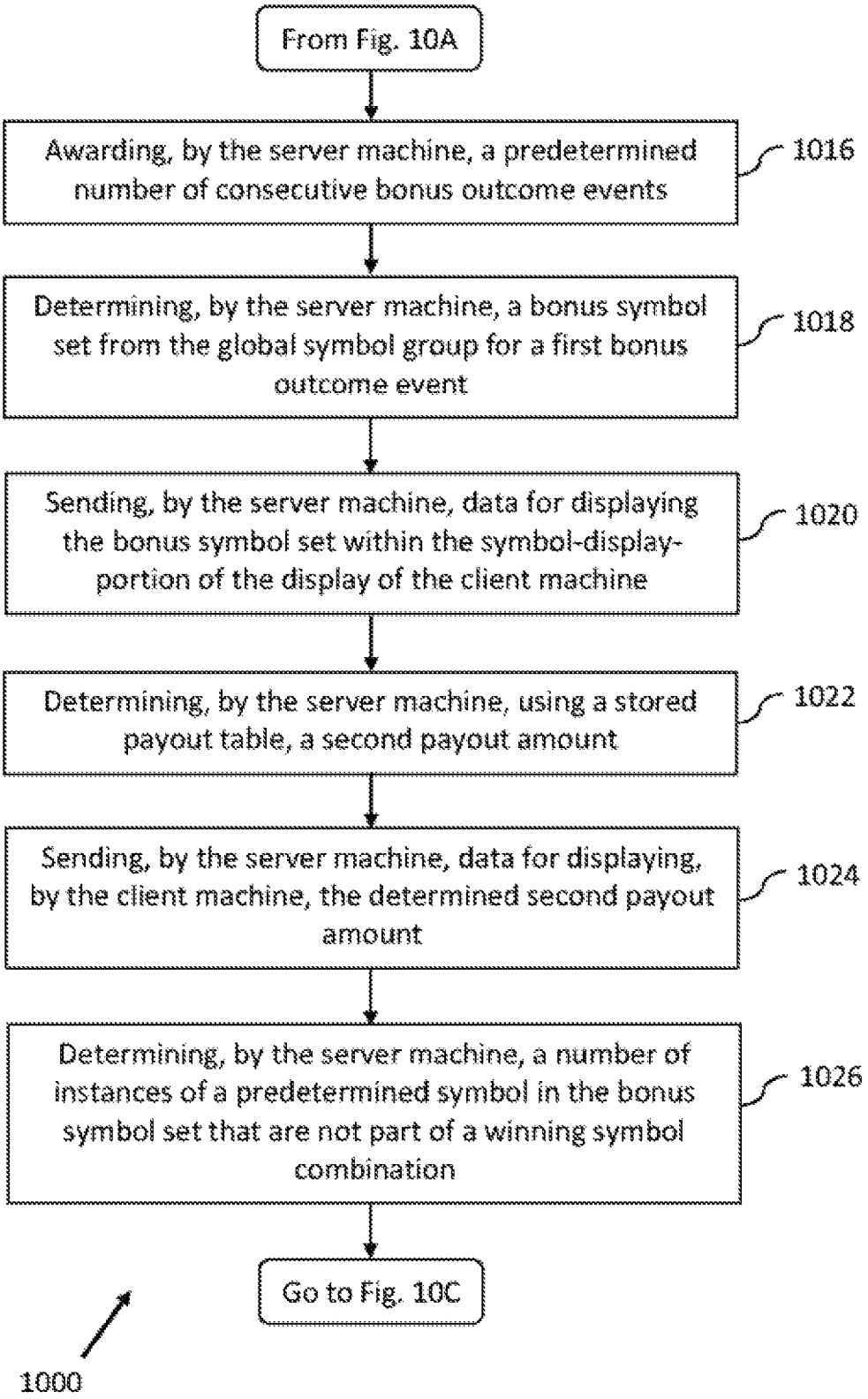
FIG. 10B is a second part of the flow chart of FIG. 10A, in accordance with example embodiments.
Figure 10C:
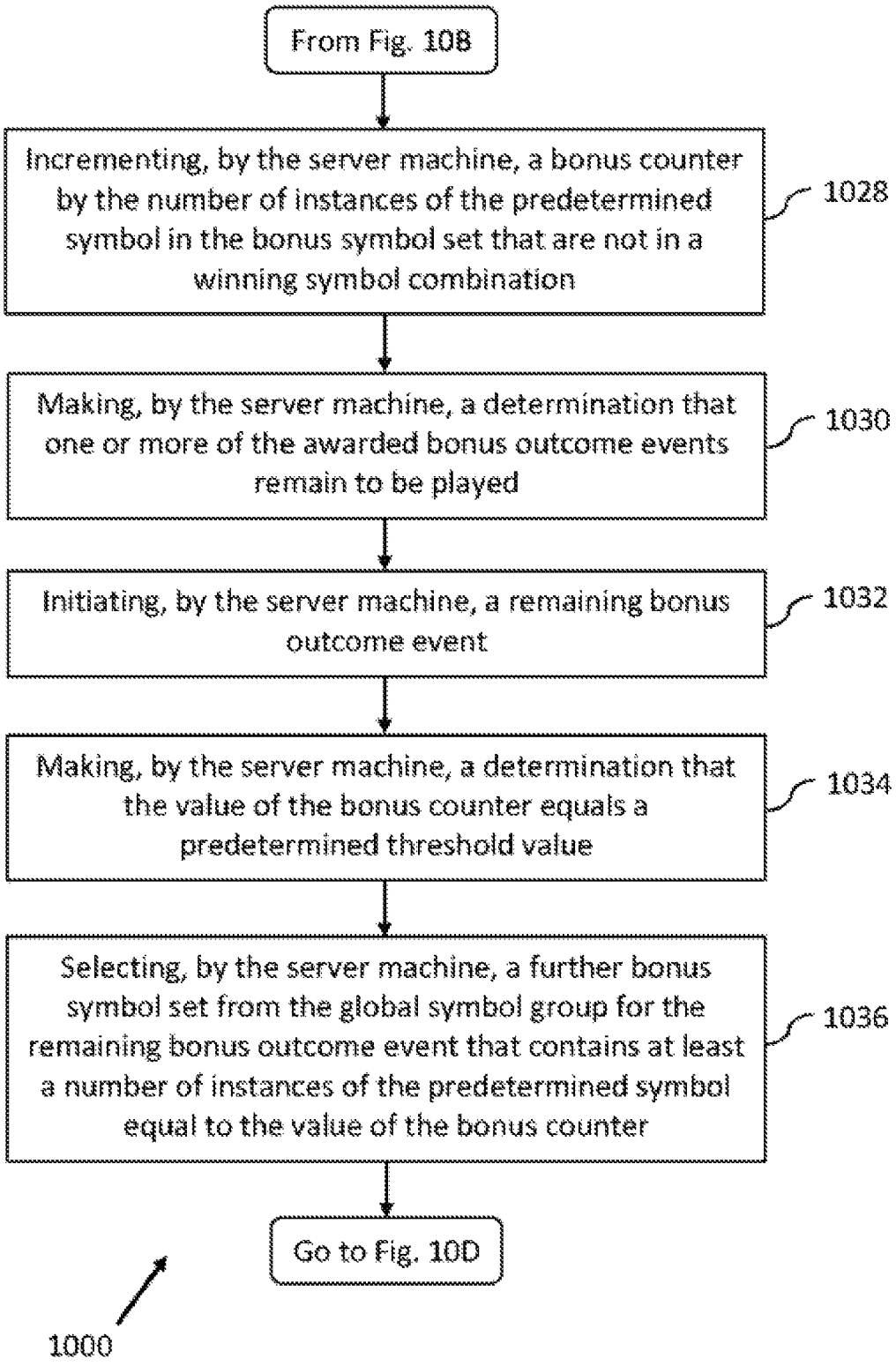
FIG. 10C is a third part of the flow chart of FIG. 10A, in accordance with example embodiments.

Turning to FIG. 10B, block 1016 includes awarding, by the server machine 100*a*, a predetermined number of consecutive bonus outcome events.

Next, block 1018 includes determining, by the server machine 100*a*, a bonus symbol set from the global symbol group for a first bonus outcome event.

Next, block 1020 includes sending, by the server machine 100*a*, data for displaying, by the display 110*b* of the client machine 100*b*, the bonus symbol set within the symbol-display-portion of the display.

Next, block 1022 includes determining, by the server machine 100*a*, using a stored payout table, a second payout amount associated with the bonus symbol set.

Next, block 1024 includes sending, by the server machine 100*a*, data for displaying, by the display device 110*b* of the client machine 100*b*, the determined second payout amount.

Next, block 1026 includes determining, by the server machine 100*a*, a number of instances of a predetermined symbol in the bonus symbol set that are not in a winning symbol combination.

Turning to FIG. 100, block 1028 includes incrementing, by the server machine 100*a*, a bonus counter by the number of instances of the predetermined symbol in the bonus symbol set that are not in a winning symbol combination.

Next, block 1030 includes making, by the server machine 100*a*, a determination that one or more of the awarded bonus outcome events remain to be played.

Next, block 1032 includes initiating, by the server machine 100*a*, a remaining bonus outcome event.

Next, block 1034 includes making, by the server machine 100*a*, a determination that the value of the bonus counter equals a predetermined threshold value.

Next, block 1036 includes selecting, by the server machine 100*a*, a further bonus symbol set from the global symbol group for the remaining bonus outcome event that contains at least a number of instances of the predetermined symbol equal to the value of the bonus counter.

Figure 10D:
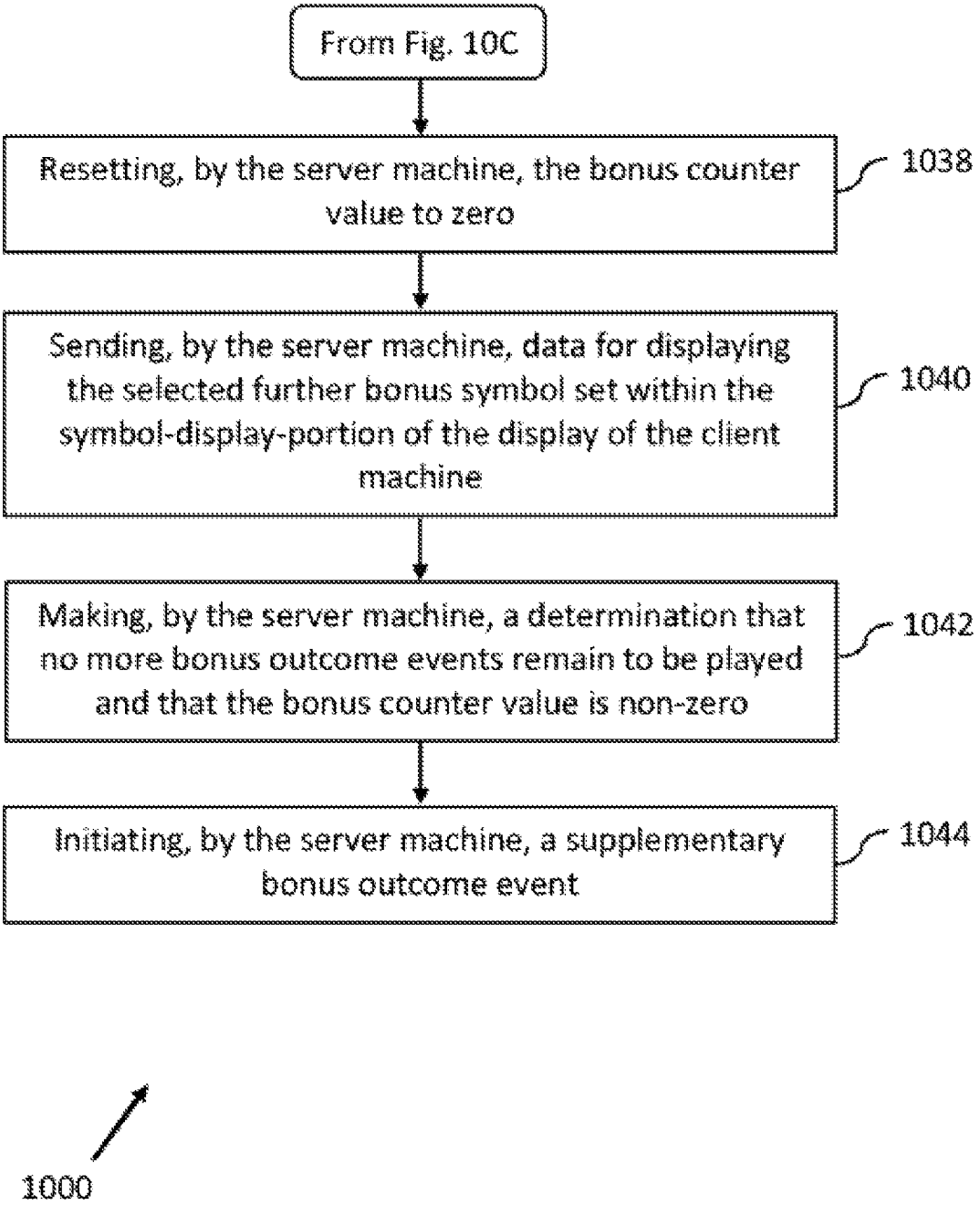
FIG. 10D is a fourth part of the flow chart of FIG. 10A, in accordance with example embodiments.

Turning to FIG. 10D, block 1038 includes resetting, by the server machine 100*a*, the bonus counter value to zero.

Next, block 1040 includes sending, by the server machine 100*a*, data for displaying, by the display 110*b* of the client machine 100*b*, the selected further bonus symbol set within the symbol-display-portion of the display.

Next, block 1042 includes making, by the server machine 100*a*, a determination that no more bonus outcome events remain to be played and that the bonus counter value is non-zero.

Next, block 1044 includes initiating, by the server machine 100*a*, a supplementary bonus outcome event.

Figure 11A:
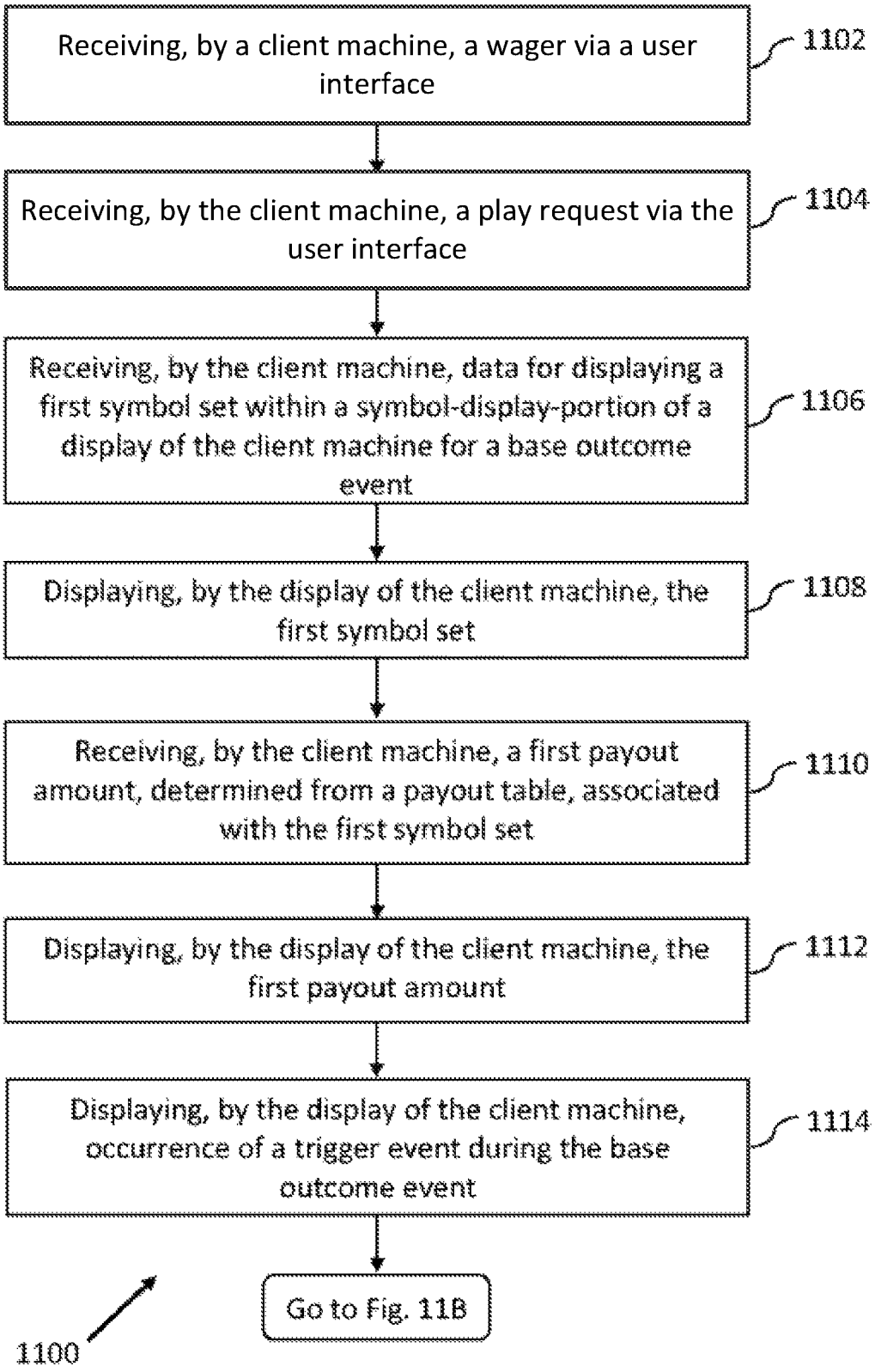
FIG. 11A is a first part of a flow chart, in accordance with example embodiments.
Figure 11B:
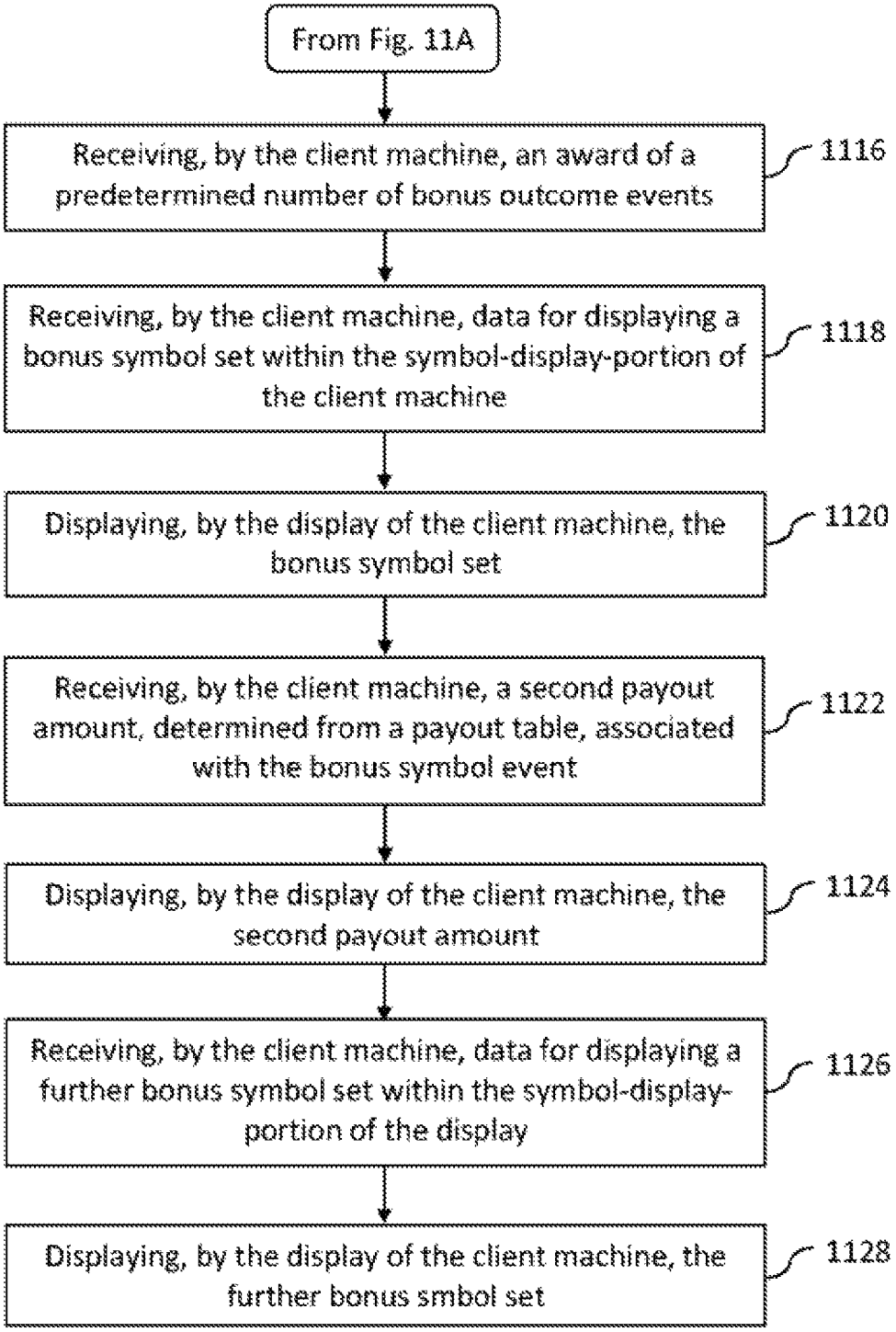
FIG. 11B is a second part of the flow chart of FIG. 11A, in accordance with example embodiments.

FIGS. 11A-11B depict a flowchart showing a set of operations 1100 (or more simply, "the set 1100") that can, for example, be carried out using client machine 100*b*. Note that several of the operations described in connection with FIGS. 11A-11B parallel operations described in connection with FIGS. 3A-3D and FIGS. 10A-10D. As such, variations of the operations described in connection with FIGS. 3A-3D and FIGS. 10A-10D are likewise applicable to the operations described in connection with FIGS. 11A-11B. However, for the sake of brevity, these variations are not repeated. The client machine 100*b*, in performing the set 1000, can perform the operations described above with respect to machine 100.

Turning to FIG. 11A, block 1102 includes receiving, by the client machine 100*b*, a wager via the user interface 104*b*. Client machine 100*b* can transmit the received wager or data indicative thereof over the communication network 116 to server machine 100*a*.

Next, block 1104 includes receiving, by the client machine 100*b*, a play request via the user interface 104*b*. Client machine 100*b* can transmit the received play request or data indicative thereof over the communication network 116 to server machine 100*a*.

Next, block 1106 includes receiving, by the client machine 100*b*, data for displaying a first symbol set within the symbol-display-portion of the display 110*b* for a first base outcome event.

Next, block 1108 includes displaying, by the display 100*b* of the client machine 100*b*, the first symbol set.

Next, block 1110 includes receiving, by the client machine 100*b*, a first payout amount, determined from a payout table, associated with the first symbol set.

Next, block 1112 includes displaying, by the display 110*b* of the client machine 100*b*, the determined first payout amount.

Next, block 1114 includes displaying, by the display 110*b* of the client machine 100*b*, occurrence of a trigger event during the base outcome event.

Turning to FIG. 11B, block 1116 includes receiving, by the client machine 100*b*, an award of a predetermined number of consecutive bonus outcome events.

Next, block 1118 includes receiving, by the client machine 100*b*, data for displaying a bonus symbol set within a symbol-display-portion of the display 110*b*.

Next, block 1120 includes displaying, by the display 100*b* of the client machine 100*b*, the bonus symbol set.

Next, block 1122 includes receiving, by the client machine 100*b*, a second payout amount, determined from a payout table, associated with the bonus symbol set.

Next, block 1124 includes displaying, by the display 110*b* of the client machine 100*b*, the determined second payout amount.

Next, block 1126 includes receiving, by the client machine 100*b*, data for displaying a further bonus symbol set within the symbol-display-portion of the display 110*b*.

Next, block 1128 includes displaying, by the display 110*b* of the client machine 100*b*, the further bonus symbol set.

Figure 12A:
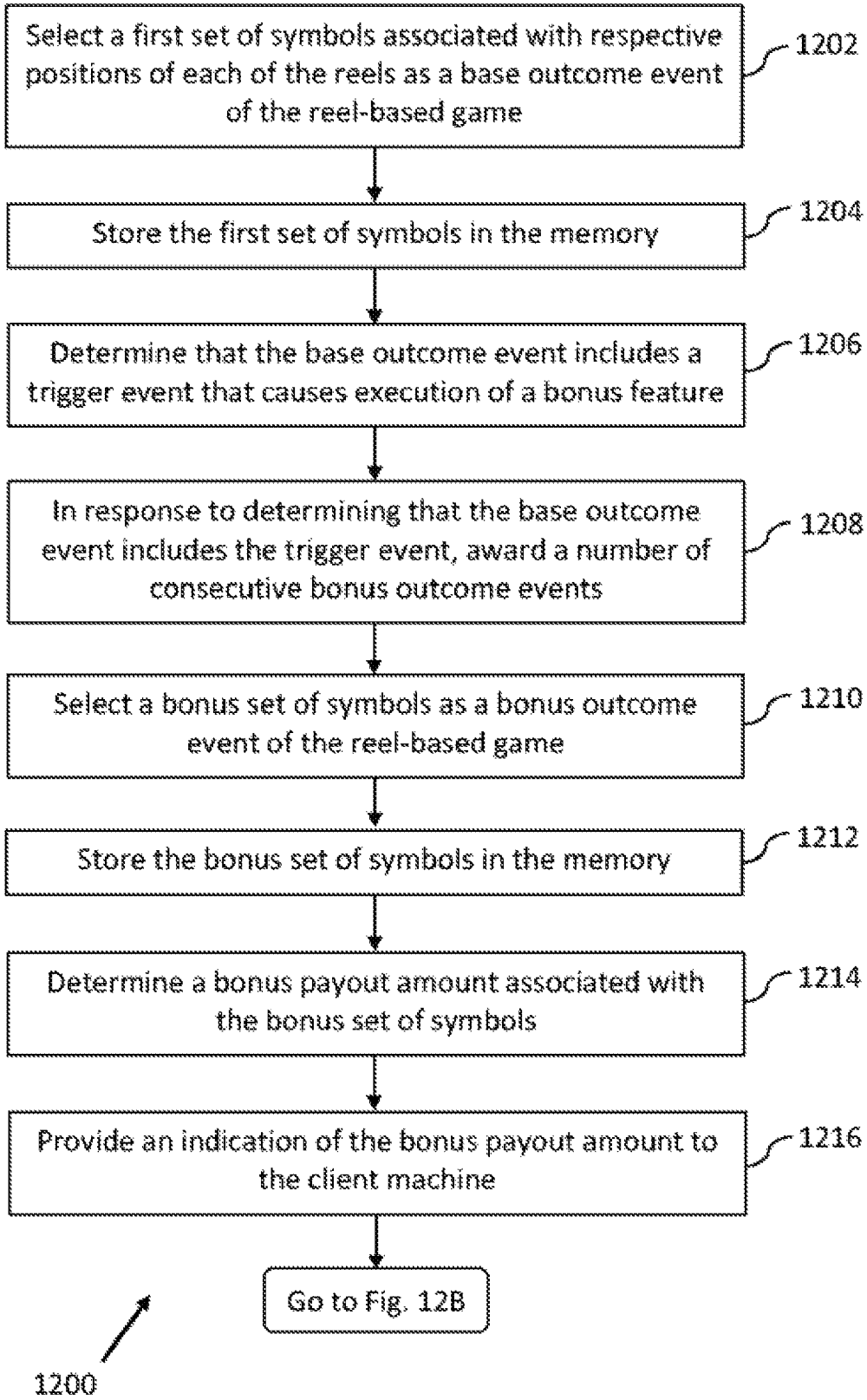
FIG. 12A is first part of a flow chart, in accordance with example embodiments.
Figure 12B:
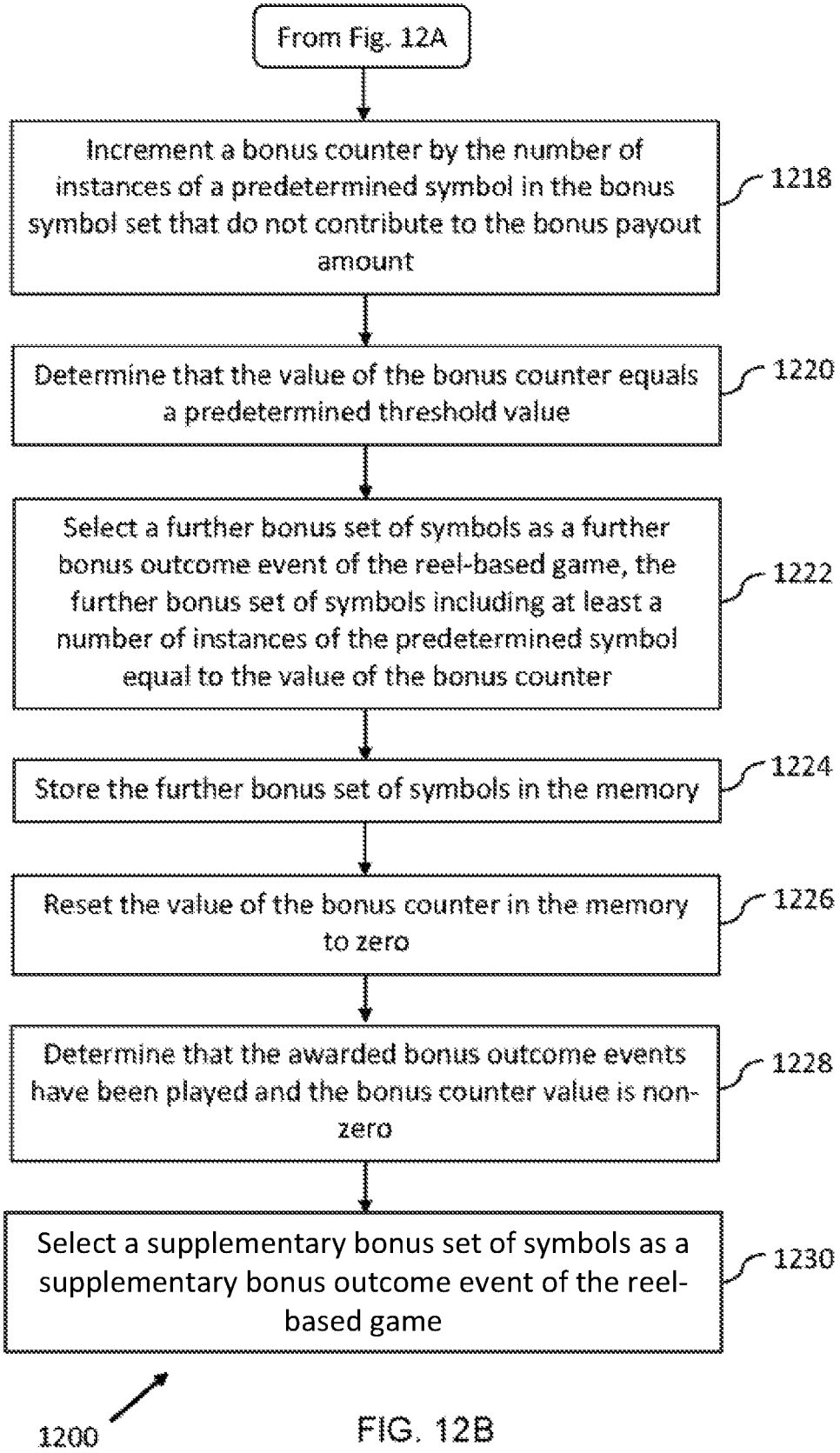
FIG. 12B is a second part of the flow chart of FIG. 12A, in accordance with example embodiments.

FIGS. 12A-12B depict a flowchart showing a set of operations 1200 (or more simply, "the set 1200") that can, for example, be carried out using server machine 100*a* and/or client machine 100*b*. To the extent that a client machine carries out any of the set 1200, these operations may also include displaying various types of information, such as symbol sets, payout amounts, and so on. Note that several of the operations described in connection with FIGS. 12A-12B parallel operations described in connection with FIGS. 3A-3D, FIGS. 10A-10D, and FIGS. 11A-11B. As such, variations of the operations described in connection with FIGS. 3A-3D, FIGS. 10A-10D, and FIGS. 11A-11B are likewise applicable to the operations described in connection with FIGS. 12A-12B.

Turning to FIG. 12A, block 1202 includes selecting a first set of symbols associated with respective positions of each of the reels as a base outcome event of the reel-based game.

Next, block 1204 includes storing the first set of symbols in the memory.

Next, block 1206 includes determining that the base outcome event includes a trigger event that causes execution of a bonus feature.

Next, block 1208 includes, responsive to determining that the base outcome event includes the trigger event, awarding a number of consecutive bonus outcome events.

Next, block 1210 includes selecting a bonus set of symbols associated with respective positions of each of the reels as a first bonus outcome event of the reel-based game.

Next, block 1212 includes storing the bonus set of symbols in the memory.

Next, block 1214 includes determining a bonus payout amount associated with the bonus set of symbols.

Next, block 1216 includes providing an indication of the bonus payout amount to the client machine.

Turning to FIG. 12B, block 1218 includes incrementing a bonus counter in the memory by the number of instances of a predetermined symbol in the bonus set of symbols that do not contribute to the bonus payout amount.

Next, block 1220 includes determining that the value of the bonus counter equals a predetermined threshold value.

Next, block 1222 includes selecting a further (second) bonus set of symbols associated with respective positions of each of the reels as a further bonus outcome event of the reel-based game, the further bonus set of symbols including at least a number of instances of the predetermined symbol equal to the value of the bonus counter.

Next, block 1224 includes storing the further bonus set of symbols in the memory.

Next, block 1226 includes resetting the value of the bonus counter in the memory to zero.

Next, block 1228 includes determining that the awarded bonus outcome events have been played and the bonus counter value is non-zero.

Next, block 1230 includes, responsive to determining that the awarded bonus outcome events have been played and that the bonus counter value is non-zero, selecting a supplementary (third) bonus set of symbols as a supplementary bonus outcome event of the reel-based game.

The trigger event may involve the set of symbols including at least n trigger symbols. The value of n may take on values such as 1, 2, 3, and so on. The trigger symbols may be Wild symbols. In some embodiments, after selecting the second bonus set of symbols, the bonus counter may be reset to zero.

In some embodiments, determining that the base outcome event includes the trigger event may involve awarding a number of consecutive bonus outcome events. The consecutive bonus outcome events may include the first bonus outcome event and the second bonus outcome event.

Some embodiments may further involve determining that the awarded number of consecutive bonus outcome events have been played and that the bonus counter is non-zero, and possibly in response to this determination, selecting a third bonus set of symbols associated with respective positions of each of the reels as a third bonus outcome event of the bonus game.

In some embodiments, the predetermined symbol is a Wild symbol.

In some embodiments, each reel comprises a respective cyclical sequence of symbols. Selecting the first bonus set of symbols and the second bonus set of symbols may involve, for each reel, randomly selecting a respective reel position that displays a subsequence of the symbols on the reel that are part of the first bonus set of symbols and the second bonus set of symbols, respectively.

In some embodiments, selecting the first bonus set of symbols and the second bonus set of symbols may involve simulating a spin of all reels for each selected bonus set of symbols.

In some embodiments, selecting each of the first bonus set of symbols and the second bonus set of symbols may involve transmitting, to the client machine, a representation of the selected symbol set. Reception of the selected symbol set may cause the client machine to display a spin of the plurality of reels resulting in the selected symbol set. Further, incrementing the bonus counter by the number of instances of the predetermined symbol, in the bonus symbol set, that do not contribute to any winning combination may involve causing the client machine to display an animated avatar interacting with the reels to (i) remove the instances of the predetermined symbol in the bonus symbol set that do not contribute to any winning combination from the reels, and (ii) increment the bonus counter. Alternatively or additionally, in an iteration of the bonus game in which the accumulated predetermined symbols are deployed into the selected symbol set, causing the client machine to display the bonus game spin may involve causing the client machine to display the animated avatar interacting with the reels to deploy the accumulated predetermined symbols.

In some embodiments, both the base game and the bonus game have five reels and each of the five reels displays three symbols at a time.

In some embodiments, when the selected symbol set includes a winning combination, the bonus game operations further may involve determining a bonus payout amount associated with the selected symbol set, and transmitting, to the client machine, an indication of the bonus payout amount. The bonus payout amount may be based on any predetermined symbols deployed on the plurality of reels. The client machine may be associated with a credit account. The credit account may be debited to play the base game, credited in response to the trigger event, and credited by the bonus payout amount.

In some embodiments, an extent of accumulated symbols may be displayed adjacent to the reels.

In some embodiments, the threshold number is at least 2.

The one or more processors that carry out blocks 1202-1230 may simultaneously execute reel-based games in real time on behalf of at least 30 client machines, where each of the at least 30 client machines communicates with the one or more processors by way of a wide-area packet-switched network. In some cases, the one or more processors may simultaneously execute reel-based games in real time on behalf of more or fewer than 30 client machines. For instance, this simultaneous execution may involve 10, 20, 50, 100, or 1000 client machines, or another extent of client machines.

Particularly, simultaneous execution of such a large number of reel-based games in real time necessitates computer implementation. When taking part in an online game, such as the reel-based games disclosed herein, players expect results of reel spin or symbol replacement operations to be displayed on their respective client machines in an expeditious fashion (e.g., in real time, such as a few seconds at most per either of these operations). Failure to do so may result in players becoming disinterested in the game. Consequently, the embodiments that include this simultaneous execution a large number of reel-based games in real time would not exist but for computer implementation thereof.

The client machine may include the one or more processors and the memory.

Figure 13:
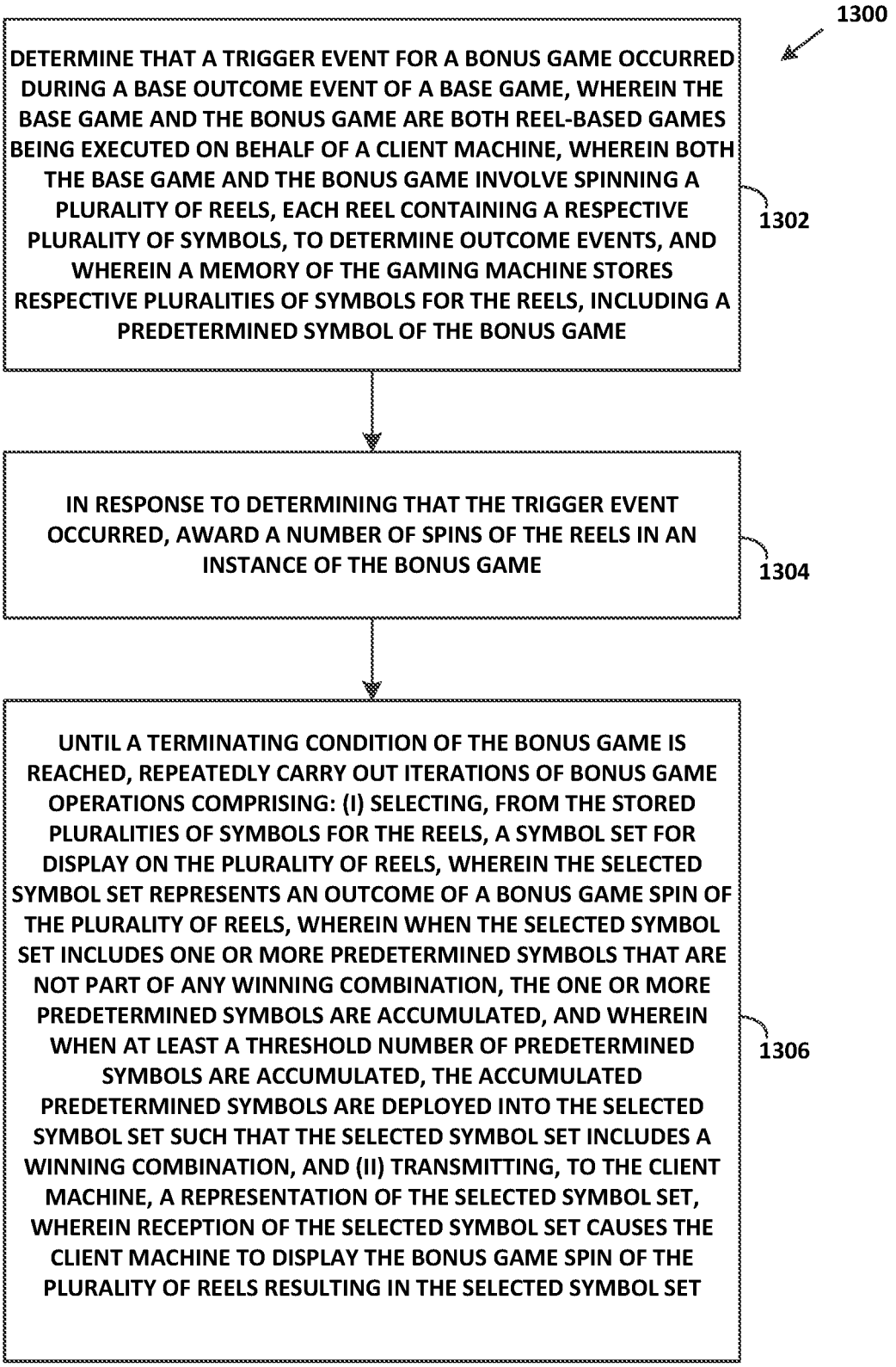
FIG. 13 is a flow chart, in accordance with example embodiments.

FIG. 13 depicts a flowchart showing a set of operations 1300 (or more simply, "the set 1300") that can, for example, be carried out using server machine 100*a* and/or client machine 100*b*. To the extent that a client machine carries out any of the set 1300, these operations may also include displaying various types of information, such as symbol sets, payout amounts, and so on. Note that several of the operations described in connection with FIG. 13 parallel operations described in connection with FIGS. 3A-3D, FIGS. 10A-10D, FIGS. 11A-11B, and FIGS. 12A-12B. As such, variations of the operations described in connection with FIGS. 3A-3D, FIGS. 10A-10D, FIGS. 11A-11B, and FIGS. 12A-12B are likewise applicable to the operations described in connection with FIG. 13.

Block 1302 may involve determining that a trigger event for a bonus game occurred during a base outcome event of a base game. The base game and the bonus game may both be reel-based games being executed on behalf of a client machine. Further, both the base game and the bonus game may involve spinning a plurality of reels, each reel containing a respective plurality of symbols, to determine outcome events. A memory of the gaming machine may store respective pluralities of symbols for the reels, including a predetermined symbol of the bonus game.

Next, block 1304 may involve, possibly in response to determining that the trigger event occurred, awarding a number of spins of the reels in an instance of the bonus game.

Next, block 1306 may involve, until a terminating condition of the bonus game is reached, repeatedly carrying out iterations of bonus game operations. These operations may include (i) selecting, from the stored pluralities of symbols for the reels, a symbol set for display on the plurality of reels, where the selected symbol set represents an outcome of a bonus game spin of the plurality of reels, where, when the selected symbol set includes one or more predetermined symbols that are not part of any winning combination, the one or more predetermined symbols are accumulated, and where, when at least a threshold number of predetermined symbols are accumulated, the accumulated predetermined symbols are deployed into the selected symbol set such that the selected symbol set includes a winning combination, and (ii) transmitting, to the client machine, a representation of the selected symbol set, where reception of the selected symbol set causes the client machine to display the bonus game spin of the plurality of reels resulting in the selected symbol set.

In some embodiments, the terminating condition may include where the awarded number of bonus game spins have been performed. The terminating condition may also include where there are no accumulated predetermined symbols that have not been deployed.

In some embodiments, both the base game and the bonus game may have five reels and each of the five reels displays three symbols at a time. Alternatively or additionally, an extent of accumulated symbols may be displayed adjacent to the reels.

In some embodiments, the predetermined symbol is a Wild symbol.

In some embodiments, each reel comprises a respective cyclical sequence of symbols. Selecting the symbol set for display on the plurality of reels may include, for each reel, randomly selecting a respective reel position that displays a subsequence of the symbols on the reel that are part of the selected symbol set.

In some embodiments, selecting the symbol set for display on the plurality of reels involve simulating a spin of all reels.

In some embodiments, in an iteration of the bonus game in which a predetermined symbol is accumulated, causing the client machine to display the bonus game spin may involve causing the client machine to display an animated avatar interacting with the reels to accumulate the predetermined symbol. Further, in an iteration of the bonus game in which the accumulated predetermined symbols are deployed into the selected symbol set, causing the client machine to display the bonus game spin may involve causing the client machine to display the animated avatar interacting with the reels to deploy the accumulated predetermined symbols.

Figure 14:
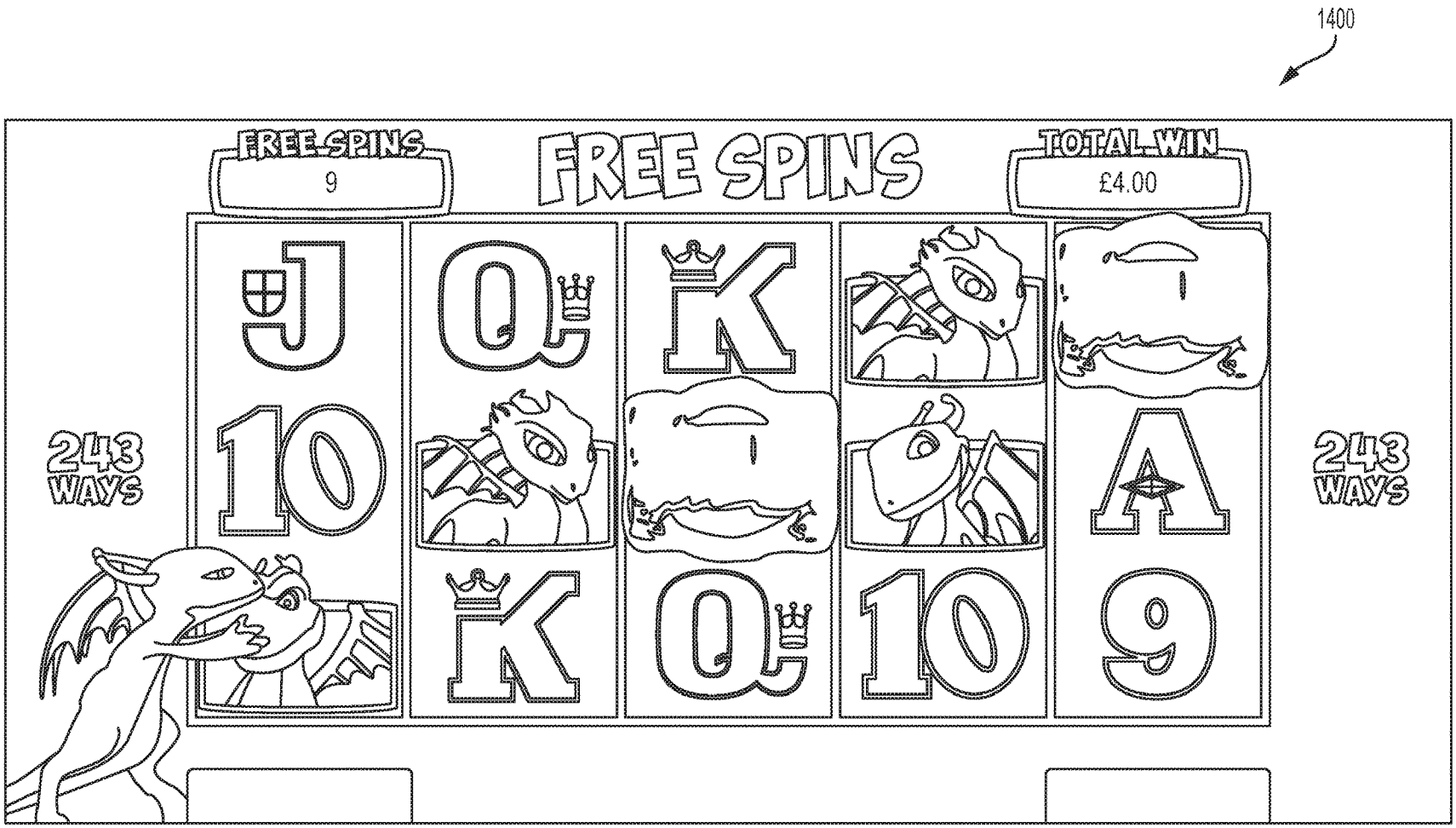
FIG. 14 depicts elements displayable by a display of a machine, in accordance with example embodiments.
Figure 15:
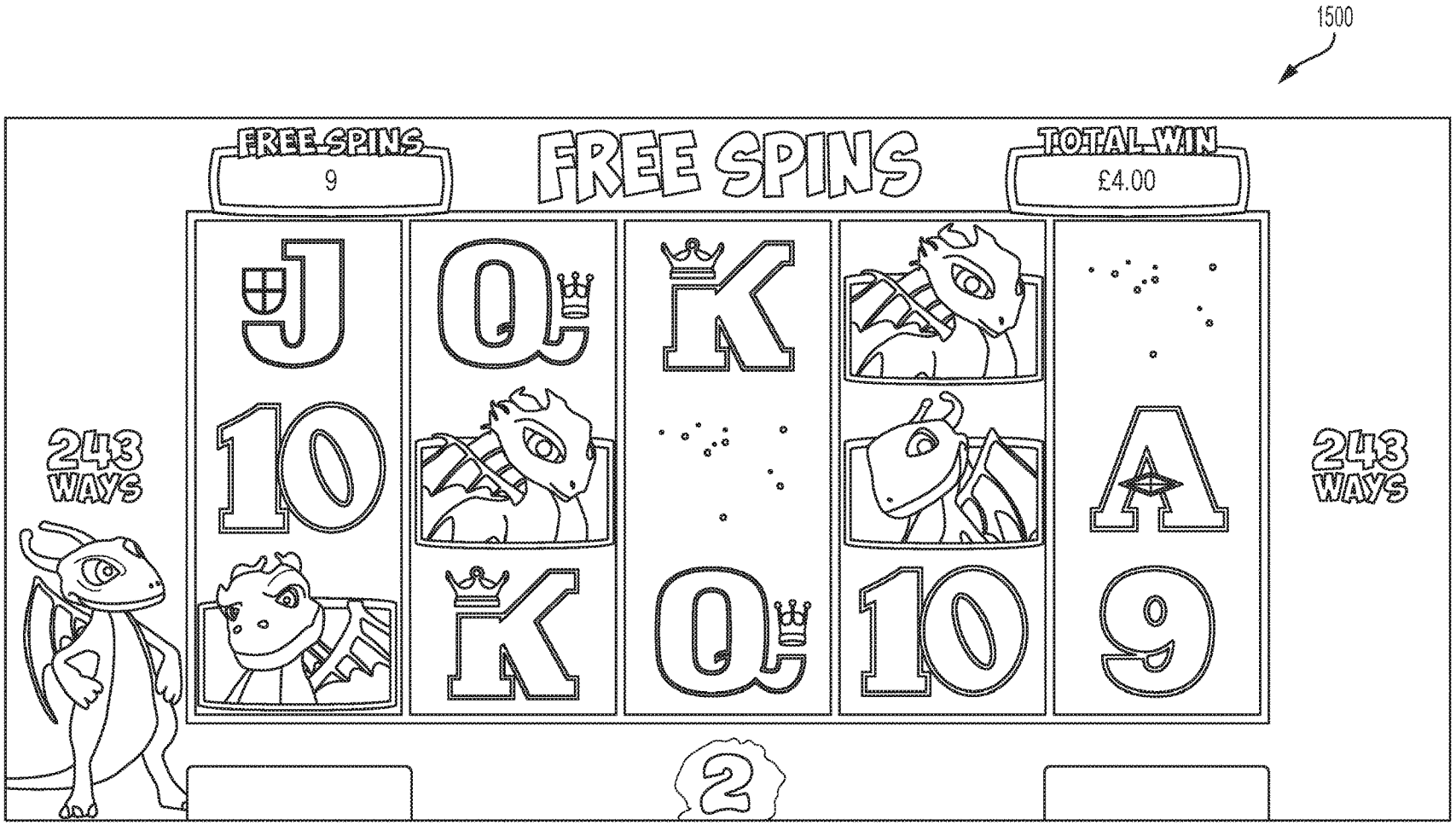
FIG. 15 depicts elements displayable by a display of a machine, in accordance with example embodiments.
Figure 16:
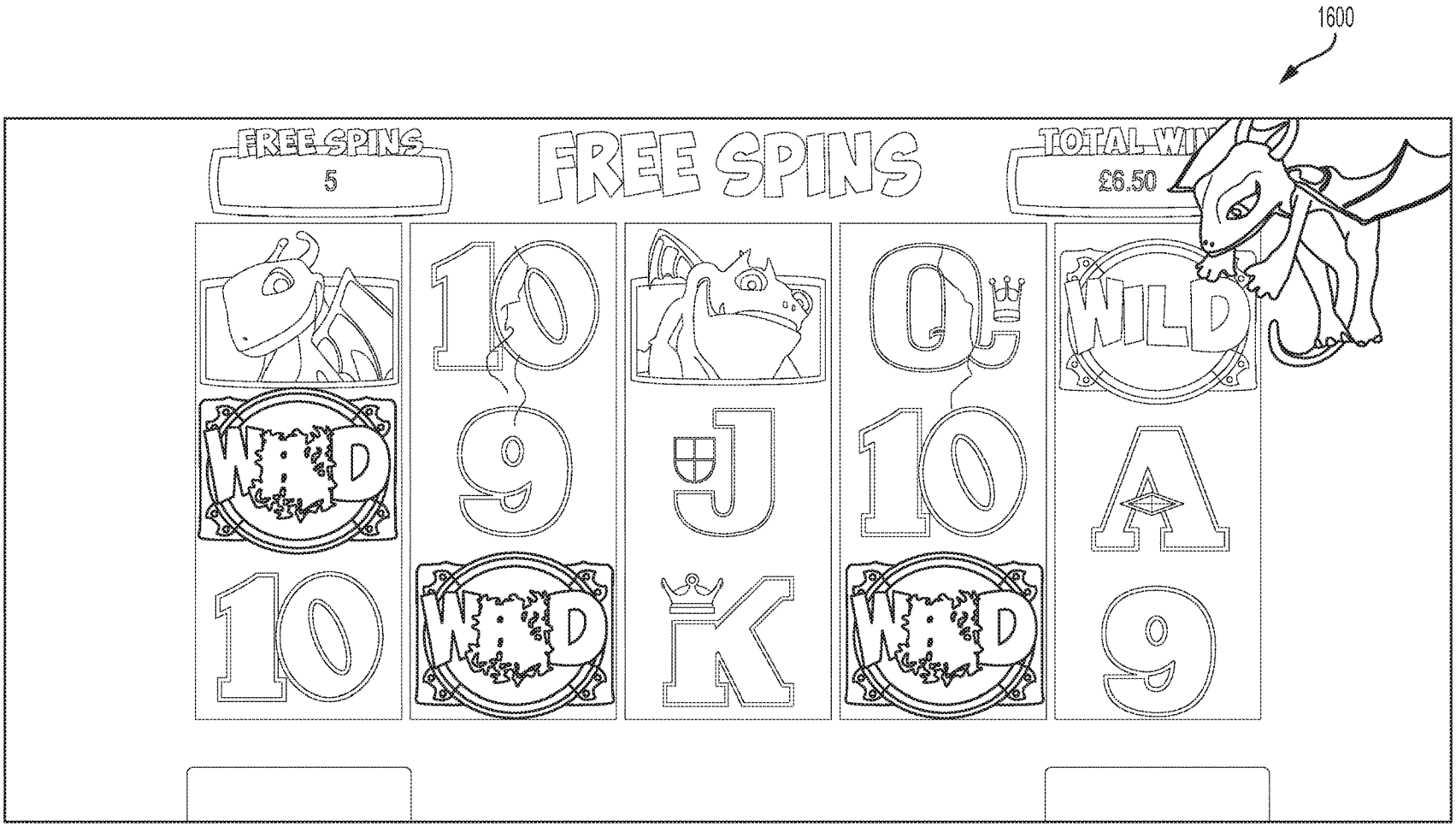
FIG. 16 depicts elements displayable by a display of a machine, in accordance with example embodiments.

FIGS. 14, 15, and 16 provide an example of such animation. In FIG. 14, display 1400 depicts a dragon avatar collecting predetermined (Wild) symbols appearing at arrangement positions C3,R2 and C5,R1 on a five-column, three-row matrix of symbols. In FIG. 15, display 1500 depicts a bonus counter with a value of 2 in the middle of the bottom of the display. The predetermined symbols have been removed from their respective arrangement positions on the reels. In FIG. 16, display 1600 depicts the dragon avatar deploying 3 collected predetermined symbols on the reel at arrangement positions C1,R2, C2,R3, and C4,R3. These deployed symbols may replace symbols that would otherwise appear at the arrangement positions. There was at least one spin of the reels between display 1500 and display 1600, and in this unshown spin or spins, a further predetermined symbol was collected. The animations depicted in FIGS. 14-16 are for purpose of example, and other animations may be used instead.

In some embodiments, when the selected symbol set includes a winning combination, the bonus game operations further involve determining a bonus payout amount associated with the selected symbol set, and transmitting, to the client machine, an indication of the bonus payout amount. The bonus payout amount may be based on any predetermined symbols on the plurality of reels. The client machine may be associated with a credit account, and the credit account may be debited to play the base game, credited in response to the trigger event, and credited by the bonus payout amount.

In some embodiments, a gaming machine may simultaneously executes base games or bonus games in real time on behalf of at least 30 client machines, and each of the at least 30 client machines may communicate with the gaming machine by way of a wide-area packet-switched network. As noted previously, such an arrangement requires computer implementation.

In some embodiments, deploying the accumulated predetermined symbols may involve replacing the threshold number of symbols in the selected symbol set with the accumulated predetermined symbols. The threshold number may be at least 2. For instance, the threshold number may be 2, 3, 4, etc.

In a further embodiment that may be a variation of that of FIGS. 12A and 12B and/or FIG. 13, a gaming system may be configured for symbol replacement in a reel-based game. The reel-based game may be executed on behalf of a client machine, and involve spinning a plurality of reels to determine outcome events.

The gaming system may include a plurality of gaming devices each including at least one display device and a plurality of input devices including (i) an acceptor of a physical item associated with a monetary value, (ii) a validator configured to identify the physical item, and (iii) a cash-out button actuatable to cause an initiation of a payout associated with a credit account.

The gaming system may also include one or more gaming device processors, and one or more gaming device memory devices. The gaming memory devices may store (i) respective pluralities of symbols for the reels and (ii) a plurality of gaming device instructions executable by the one or more gaming device processors to perform any of the operations depicts in reference to FIGS. 12A, 12B, and/or 13.

V. Conclusion

While one or more disclosed operations have been described as being performed by certain entities (e.g., machine 100, server machine 100*a*, or client machine 100*b*), one or more of the operations may be performed by any entity, including but not limited to those described herein. As such, while this disclosure includes examples in which the server machine 100*a* performs select operations and sends data to the client machine 100*b*, such that the client machine 100*b* may perform complementing operations and receive the data, variations may to those operations may be made while adhering to the general server-client dichotomy and the scope of the disclosed machines and methods.

For example, rather than the server machine 100*a* sending select data (e.g., a symbol set) to the client machine 100*b*, such that the client machine may generate and display appropriate images, the server machine 100*a* may itself generate the images and send them to the client machine 100*b* for display. Indeed, it will be appreciated by one of ordinary skill in the art that the "break point" between the server machine's operations and the client machine's operations may be varied.

Further, the described operations throughout this application need not be performed in the disclosed order, although in some examples, the recited order may be preferred. Also, not all operations need to be performed to achieve the desired advantages of disclosed machines and methods, and therefore not all operations are required.

Additionally, any enumeration of elements, blocks, or steps in this specification or the claims is for purposes of clarity. Thus, such enumeration should not be interpreted to require or imply that these elements, blocks, or steps adhere to a particular arrangement or are carried out in a particular order.

While examples have been described in terms of select embodiments, alterations and permutations of these embodiments will be apparent to those of ordinary skill in the art. Other changes, substitutions, and alterations are also possible without departing from the disclosed machines and methods in their broader aspects as set forth in the following claims.

What is claimed is:

1. A computer-implemented method for symbol replacement in a reel-based game, wherein the reel-based game is executed by a gaming machine on behalf of a client machine, wherein the reel-based game includes a base game and a bonus game, both involving spinning a plurality of reels to determine outcome events, and wherein a memory stores respective pluralities of symbols for the reels, the method comprising:

selecting, by one or more processors and from the memory, a set of symbols associated with respective positions of each of the reels as a base outcome event of the base game;

determining, by the one or more processors, that the base outcome event includes a trigger event that causes execution of the bonus game;

selecting, by the one or more processors and from the memory, a first bonus set of symbols associated with respective positions of each of the reels as a first bonus outcome event of the bonus game;

incrementing, by the one or more processors, a bonus counter by a number of instances of a predetermined symbol, in the first bonus set of symbols, that do not contribute to any winning combination of symbols in the first bonus set of symbols based on a table of winning combinations for the bonus game;

determining, by the one or more processors, that the bonus counter is at least equal to a threshold number; and selecting, by the one or more processors and from the memory, a second bonus set of symbols associated with respective positions of each of the reels as a second bonus outcome event of the bonus game, wherein the second bonus set of symbols includes at least the threshold number of instances of the predetermined symbol, and wherein the second bonus set of symbols includes a winning combination.

2. The method of claim 1, further comprising:

after selecting the second bonus set of symbols, resetting the bonus counter to zero.

3. The method of claim 1, wherein determining that the base outcome event includes the trigger event comprises:

awarding a number of consecutive bonus outcome events, wherein the consecutive bonus outcome events include the first bonus outcome event and the second bonus outcome event.

4. The method of claim 3, further comprising:

determining that the awarded number of consecutive bonus outcome events have been played and that the bonus counter is non-zero; and in response to determining that the awarded number of consecutive bonus outcome events have been played and that the bonus counter is non-zero, selecting a third bonus set of symbols associated with respective positions of each of the reels as a third bonus outcome event of the bonus game.

5. The method of claim 1, wherein the predetermined symbol is a Wild symbol.

6. The method of claim 1, wherein each reel comprises a respective cyclical sequence of symbols, and wherein selecting the first bonus set of symbols and the second bonus set of symbols comprises:

for each reel, randomly selecting a respective reel position that displays a subsequence of the symbols on the reel that are part of the first bonus set of symbols and the second bonus set of symbols, respectively.

7. The method of claim 1, wherein selecting the first bonus set of symbols and the second bonus set of symbols comprises:

simulating a spin of all reels for each selected bonus set of symbols.

8. The method of claim 1, wherein selecting each of the first bonus set of symbols and the second bonus set of symbols comprises:

transmitting, to the client machine, a representation of the selected symbol set, wherein reception of the selected symbol set causes the client machine to display a spin of the plurality of reels resulting in the selected symbol set.

9. The method of claim 8, wherein incrementing the bonus counter by the number of instances of the predetermined symbol, in the first bonus set of symbols, that do not contribute to any winning combination comprises:

causing the client machine to display an animated avatar interacting with the reels to (i) remove the instances of the predetermined symbol in the first bonus set of symbols that do not contribute to any winning combination from the reels, and (ii) increment the bonus counter.

10. The method of claim 9, wherein, in an iteration of the bonus game in which accumulated predetermined symbols are deployed into the selected symbol set, causing the client machine to display the spin comprises:

causing the client machine to display the animated avatar interacting with the reels to deploy the accumulated predetermined symbols.

11. The method of claim 1, wherein both the base game and the bonus game have five reels and each of the five reels displays three symbols at a time.

12. The method of claim 1, wherein the gaming machine simultaneously executes base games or bonus games in real time on behalf of at least 30 client machines, and wherein each of the at least 30 client machines communicates with the gaming machine by way of a wide-area packet-switched network.

13. The method of claim 1, wherein an extent of accumulated symbols is displayed adjacent to the reels.

14. The method of claim 1, wherein the threshold number is at least 2.

15. A gaming system configured for symbol replacement in a reel-based game, wherein the reel-based game is executed on behalf of a client machine, wherein the reel-based game involves spinning a plurality of reels to determine outcome events, the gaming system comprising:

a plurality of gaming devices each including at least one display device and a plurality of input devices including (i) an acceptor of a physical item associated with a monetary value, (ii) a validator configured to identify the physical item, and (iii) a cash-out button actuatable to cause an initiation of a payout associated with a credit account;

one or more gaming device processors; and one or more gaming device memory devices storing (i) respective pluralities of symbols for the reels and (ii) a plurality of gaming device instructions executable by the one or more gaming device processors to perform operations comprising:

selecting, from the gaming device memory devices, a set of symbols associated with respective positions of each of the reels as a base outcome event of a base game, wherein the set of symbols is based on the pluralities of symbols;

determining that the base outcome event includes a trigger event that causes execution of a bonus game;

selecting, from the gaming device memory devices, a first bonus set of symbols associated with respective positions of each of the reels as a first bonus outcome event of the bonus game, wherein the first bonus set of symbols is based on the pluralities of symbols;

incrementing a bonus counter by a number of instances of a predetermined symbol, in the first bonus set of symbols, that do not contribute to any winning combination of symbols in the first bonus set of symbols based on a table of winning combinations for the bonus game;

determining that the bonus counter is at least equal to a threshold number; and selecting, from the gaming device memory devices, a second bonus set of symbols associated with respective positions of each of the reels as a second bonus outcome event of the bonus game, wherein the second bonus set of symbols includes at least the threshold number of instances of the predetermined symbol, and wherein the second bonus set of symbols is based on the pluralities of symbols and includes a winning combination.

16. The gaming system of claim 15, wherein the operations further comprise:

after selecting the second bonus set of symbols, resetting the bonus counter to zero.

17. The gaming system of claim 16, wherein determining that the base outcome event includes the trigger event comprises awarding a number of consecutive bonus outcome events, wherein the consecutive bonus outcome events include the first bonus outcome event and the second bonus outcome event, and wherein the operations further comprise:

determining that the awarded number of consecutive bonus outcome events have been played and that the bonus counter is non-zero; and in response to determining that the awarded number of consecutive bonus outcome events have been played and that the bonus counter is non-zero, selecting a third bonus set of symbols associated with respective positions of each of the reels as a third bonus outcome event of the bonus game.

18. The gaming system of claim 15, wherein each reel comprises a respective cyclical sequence of symbols, and wherein selecting the first bonus set of symbols and the second bonus set of symbols comprises:

for each reel, randomly selecting a respective reel position that displays a subsequence of the symbols on the reel that are part of the first bonus set of symbols and the second bonus set of symbols, respectively.

19. The gaming system of claim 15, wherein selecting each of the first bonus set of symbols and the second bonus set of symbols comprises:

transmitting, to the client machine, a representation of the selected symbol set, wherein reception of the selected symbol set causes the client machine to display a spin of the plurality of reels resulting in the selected symbol set.

20. A non-transitory computer readable medium having stored thereon instructions that, when executed by a computing device, cause the computing device to perform operations comprising:

selecting a set of symbols associated with respective positions of each of a plurality of reels as a base outcome event of a base game;

determining that the base outcome event includes a trigger event that causes execution of a bonus game;

selecting a first bonus set of symbols associated with respective positions of each of the plurality of reels as a first bonus outcome event of the bonus game;

incrementing a bonus counter by a number of instances of a predetermined symbol, in the first bonus set of symbols, that do not contribute to any winning combination of symbols in the first bonus set of symbols based on a table of winning combinations for the bonus game;

determining that the bonus counter is at least equal to a threshold number; and selecting a second bonus set of symbols associated with respective positions of each of the plurality of reels as a second bonus outcome event of the bonus game, wherein the second bonus set of symbols includes at least the threshold number of instances of the predetermined symbol, and wherein the second bonus set of symbols includes a winning combination.

* * * * *